US008886109B2

(12) United States Patent
Chadani et al.

(10) Patent No.: US 8,886,109 B2
(45) Date of Patent: Nov. 11, 2014

(54) CLEANING UNIT, PROCESS CARTRIDGE, AND ELECTROPHOTOGRAPHIC IMAGE FORMING APPARATUS

(71) Applicant: Canon Kabushiki Kaisha, Tokyo (JP)

(72) Inventors: Kazuo Chadani, Suntou-gun (JP); Akihiro Fujiwara, Mishima (JP); Susumu Nittani, Suntou-gun (JP); Masato Tanabe, Susono (JP); Hideki Kakuta, Suntou-gun (JP); Keisuke Nomura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 13/862,743

(22) Filed: Apr. 15, 2013

(65) Prior Publication Data

US 2013/0287439 A1 Oct. 31, 2013

(30) Foreign Application Priority Data

Apr. 26, 2012 (JP) ..... 2012-101857

(51) Int. Cl.
*G03G 21/00* (2006.01)

(52) U.S. Cl.
CPC ..... *G03G 21/007* (2013.01)
USPC ..... 399/351

(58) Field of Classification Search
CPC ..... G03G 21/0011; G03G 21/0029
USPC ..... 399/350, 351
See application file for complete search history.

(56) References Cited

U.S. PATENT DOCUMENTS

| | | | | |
|---|---|---|---|---|
| 4,568,175 | A * | 2/1986 | Inowa et al. | 399/351 |
| 6,266,502 | B1 | 7/2001 | Matsuzaki et al. | |
| 6,311,037 | B1 * | 10/2001 | Hisakuni et al. | 399/350 |
| 6,721,533 | B2 * | 4/2004 | Sato et al. | 399/350 |
| 2012/0008974 | A1 | 1/2012 | Kawai et al. | |

FOREIGN PATENT DOCUMENTS

JP 6-161328 A 6/1994

* cited by examiner

*Primary Examiner* — Gregory H Curran
(74) *Attorney, Agent, or Firm* — Fitzpatrick, Cella, Harper & Scinto

(57) ABSTRACT

A cleaning unit including: frame abutment portions each including a first abutment portion and a second abutment portion; support portions each including a first support portion which abuts against the first abutment portion, and a second support portion which abuts against the second abutment portion so as to support a cleaning member in a pivotable manner about the frame abutment portions as a pivot axis; and an urging member configured to urge the cleaning member in a direction in which an elastic member is brought into contact with a photosensitive drum by pivoting the cleaning member.

19 Claims, 31 Drawing Sheets

XXVIIIB
8
6
7
50
8a
27
27c
27x
27p
27m
27s
8p
8m
8s

CLEANING UNIT, PROCESS CARTRIDGE, AND ELECTROPHOTOGRAPHIC IMAGE FORMING APPARATUS

BACKGROUND OF THE INVENTION

1. Field of the Invention

The present invention relates to a cleaning unit and a process cartridge which are used in an electrophotographic image forming apparatus, and to the electrophotographic image forming apparatus.

Herein, an electrophotographic image forming apparatus refers to an apparatus configured to form an image on a recording material (recording medium) by an electrophotographic method (electrophotographic image forming process).

Examples of the electrophotographic image forming apparatus include a printer (laser beam printer, light emitting diode (LED) printer, etc.), a copying machine, a facsimile apparatus, a word processor, and a multifunction peripheral (multifunction printer) of those apparatus.

2. Description of the Related Art

In the electrophotographic image forming apparatus (hereinafter also simply referred to as "image forming apparatus"), an electrophotographic photosensitive member as an image bearing member, which generally has a drum shape, in other words, a photosensitive drum is uniformly charged. Then, the charged photosensitive drum is subjected to selective exposure so as to form an electrostatic latent image (electrostatic image) on the photosensitive drum. Next, the electrostatic latent image formed on the photosensitive drum is developed into a toner image with toner as developer. After that, the toner image formed on the photosensitive drum is transferred onto a recording material such as a recording sheet of paper and a plastic sheet, and heat and pressure are applied to the toner image transferred onto the recording material so as to fix the toner image to the recording material. In this way, image recording is performed.

In general, such an image forming apparatus requires toner supply and maintenance of various processing units. In order to facilitate the toner supply and the maintenance, there has been practically used a process cartridge obtained by integrating the photosensitive drum, a charging unit, a developing unit, and a cleaning unit into a frame(s) of a cartridge, which is removably mounted to a main body of the image forming apparatus.

Image forming apparatus of such a process cartridge type enable a user himself/herself to perform maintenance of the image forming apparatus, and hence operability can be markedly enhanced. As a result, an image forming apparatus excellent in usability can be provided. For this reason, the image forming apparatus of the process cartridge type have been widely used.

As described above, a cleaning member as the cleaning unit configured to remove toner (residual toner) remaining on a surface of the photosensitive drum after the transfer step from the photosensitive drum is provided in the process cartridge. In some cases, it is desired that the cleaning member which abuts against the photosensitive drum be supported in a pivotable manner.

In a cleaning unit disclosed in Japanese Patent Application Laid-Open No. H06-161328, the cleaning member is supported in a pivotable manner with respect to the frame. Specifically, in the cleaning unit disclosed in Japanese Patent Application Laid-Open No. H06-161328, a support member for a cleaning blade is supported in a pivotable manner through pins by the frame, and the cleaning blade is pressed against a photosensitive member by springs.

However, the structure as described above, in which the cleaning member is supported in a pivotable manner through, for example, the pins, has problems in that a larger number of components and higher cost thereof are required, and the structure is liable to be complicated.

SUMMARY OF THE INVENTION

The present invention provides a cleaning unit, a process cartridge, and an electrophotographic image forming apparatus which enable a cleaning member to be supported in a pivotable manner with a simple structure such as a frame without use of separate members such as pins, to thereby achieve reduction in manufacturing cost and to facilitate assembly.

A cleaning unit according to an embodiment of the present invention, includes: a rotatable photosensitive drum; a cleaning member configured to remove toner from the photosensitive drum; and a frame configured to support the photosensitive drum and the cleaning member. The cleaning member includes: an elastic member which abuts against the photosensitive drum; and a support member configured to support the elastic member. The support member has frame abutment portions which abut against the frame at both end portions of the support member in a direction along a direction of a rotation axis of the photosensitive drum, respectively. Each of the frame abutment portions has: a first abutment portion formed by a surface extending in one direction; and a second abutment portion formed by a surface extending in another direction intersecting with the one direction, the first abutment portion being directed to a side opposite to a side of the photosensitive drum with respect to a first axis extending from a corresponding one of the frame abutment portions to the elastic member as viewed in the direction of the rotation axis of the photosensitive drum, the second abutment portion being directed to a side opposite to a side of the elastic member with respect to a second axis substantially orthogonal to the first axis. The frame includes cleaning member support portions which abut against the frame abutment portions at both the end portions of the support member, respectively. Each of the cleaning member support portions has: a first support portion which abuts against the first abutment portion; and a second support portion which abuts against the second abutment portion, the cleaning member support portions supporting the cleaning member in a pivotable manner about the frame abutment portions as a pivot axis. The cleaning unit further includes an urging member configured to urge the cleaning member in a direction in which the elastic member is brought into contact with the photosensitive drum by pivoting the cleaning member about the frame abutment portions as the pivot axes.

A process cartridge according to another embodiment of the present invention, includes the cleaning unit as mentioned above. The process cartridge is removably mounted to a main body of an electrophotographic image forming apparatus. The electrophotographic image forming apparatus transfers a toner image, which is formed on the photosensitive drum, onto a recording material, fixes the toner image to the recording material, and outputs the recording material.

An electrophotographic image forming apparatus according to still another embodiment of the present invention, includes the process cartridge, as mentioned above, which is removably mounted to the electrophotographic image forming apparatus which transfers a toner image, which is formed on the photosensitive drum, onto a recording material, fixes the toner image to the recording material, and outputs the recording material.

Further features of the present invention will become apparent from the following description of exemplary embodiments with reference to the attached drawings.

DESCRIPTION OF THE EMBODIMENTS

In the following, a cleaning unit, a process cartridge, and an electrophotographic image forming apparatus according to the present invention will be described in further detail with reference to the drawings.

First Embodiment

1. Overall Structure of Image Forming Apparatus

First, an overall structure of an electrophotographic image forming apparatus (image forming apparatus) 100 according to an embodiment of the present invention will be described.

Figure 1:
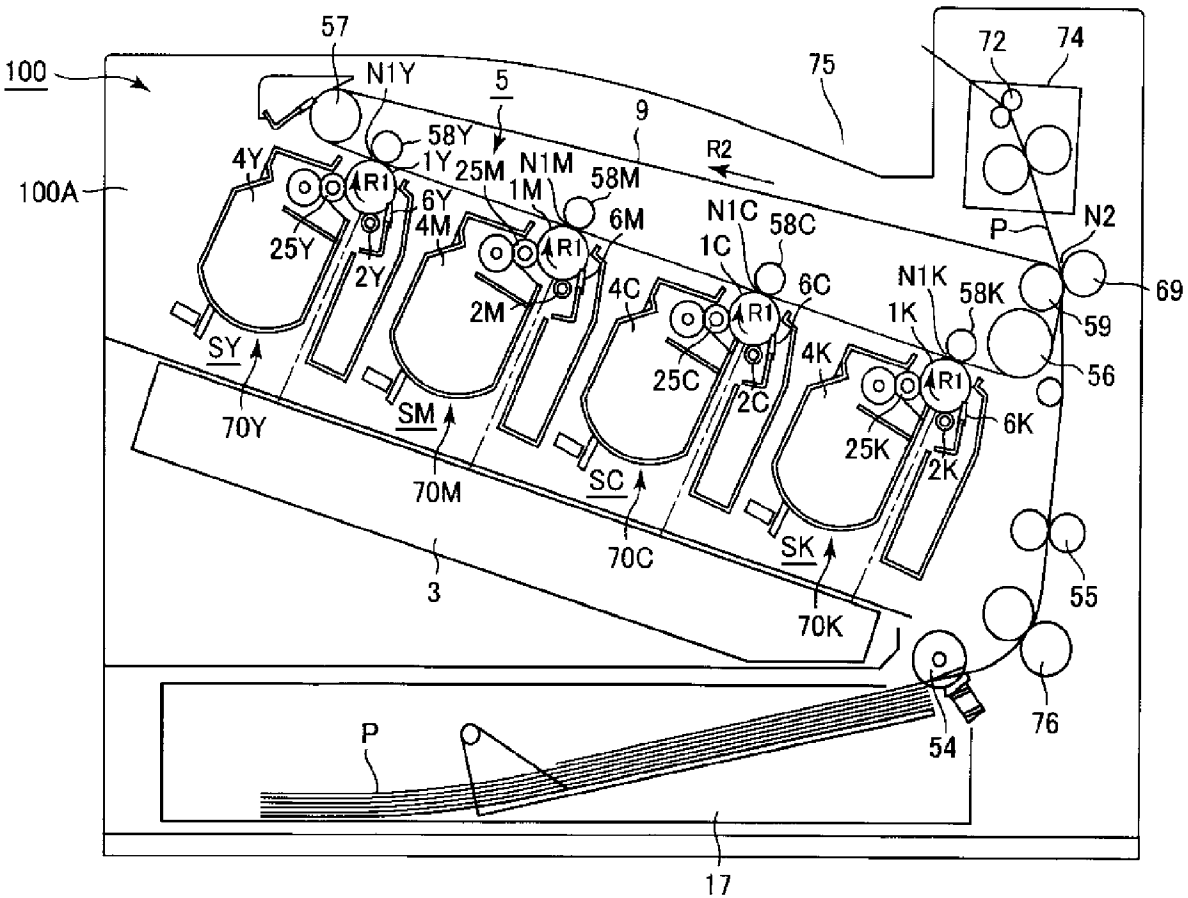
FIG. 1 is a sectional view of an electrophotographic image forming apparatus according to an embodiment of the present invention.

FIG. 1 is a sectional view illustrating the overall structure of the image forming apparatus 100 according to the embodiment. The image forming apparatus 100 includes, as a plurality of image forming portions, a first image forming portion SY configured to form an image having a color of yellow (Y), a second image forming portion SM configured to form an image having a color of magenta (M), a third image forming portion SC configured to form an image having a color of cyan (C), and a fourth image forming portion SK configured to form an image having a color of black (K).

Note that, in the embodiment, the structures and operations of the first to fourth image forming portions are substantially the same except that a color of an image to be formed is different for each image forming portion. Accordingly, in the following, in the case where the respective image forming portions are specially not required to be distinguished from each other, the suffixes of respective symbols Y, M, C, and K, which indicate which element of the image forming portion is provided, are omitted and collectively described.

The image forming apparatus 100 comprises a main body (apparatus main body) 100A including four process cartridges 70Y, 70M, 70C, and 70K which are removably mounted to mounting members (not shown) correspondingly to the first, second, third, and fourth image forming portions S, respectively. In the embodiment, the process cartridges are disposed side by side in an inclined manner with respect to a horizontal direction inside the apparatus main body 100A.

In this context, an upstream side and a downstream side in a direction in which the process cartridges 70 are mounted in the image forming apparatus 100 (direction from the near side to the far side of the drawing sheet of FIG. 1) are respectively referred to as a front side and a rear side.

The process cartridge 70 includes a drum-shaped electrophotographic photosensitive member, in other words, a photosensitive drum 1. Processing units such as a charging roller 2, a developing roller 25, and a cleaning member 6 are integrally arranged around the photosensitive drum 1. The charging roller 2 is a charging unit configured to uniformly charge a surface of the photosensitive drum 1. The developing roller 25 is a developing unit configured to develop an electrostatic latent image formed on the photosensitive drum 1 into a visible image with toner. The cleaning member 6 is a cleaning unit configured to remove toner (residual toner), remaining on the photosensitive drum 1, from the photosensitive drum 1 after the toner image formed on the photosensitive drum 1 is transferred onto a recording material P.

Further, the apparatus main body 100A includes a scanner unit 3 provided below the four process cartridges 70Y, 70M, 70C, and 70K. The scanner unit 3 is an exposure unit configured to expose the photosensitive drums 1Y, 1M, 1C, and 1K selectively based on image information so that the electrostatic latent image is formed on the photosensitive drum 1.

A cassette 17 configured to store the recording materials P is removably mounted in a lower portion of the apparatus main body 100A. The apparatus main body 100A also includes a recording material conveying unit configured to convey the recording materials P stored in the cassette 17. The recording material conveying unit conveys the recording materials P upward in the apparatus main body 100A via a secondary transfer roller 69 and an attaching portion 74. The attaching portion 74 is arranged in an upper portion of the apparatus main body 100A. The recording material conveying unit includes a feed roller 54 configured to separate and feed the recording materials P in the cassette 17 one by one, a conveying roller pair 76 configured to convey the recording material P thus fed, and a registration roller pair 55 configured to synchronize the electrostatic latent image formed on the photosensitive drum 1 and the recording material P with each other.

Further, the apparatus main body 100A includes an intermediate transfer unit 5 provided over the four process cartridges 70Y, 70M, 70C, and 70K. The intermediate transfer unit 5 is an intermediate transfer unit configured to transfer the toner images formed on the photosensitive drums 1Y, 1M, 1C, and 1K onto the recording materials P. The intermediate transfer unit 5 includes an intermediate transfer belt 9 which is an endless belt like intermediate transfer member. The intermediate transfer belt 9 is passed over a driving roller 56, a driven roller 57, primary transfer rollers 58Y, 58M, 58C, and 58K, and a secondary transfer opposing roller 59. The primary transfer rollers 58Y, 58M, 58C, and 58K are disposed opposite to the photosensitive drums 1Y, 1M, 1C, and 1K, respectively. The secondary transfer opposing roller 59 is disposed opposite to the secondary transfer roller 69.

The primary transfer rollers 58 are each a primary transfer unit configured to transfer (primarily transfer) the toners on the photosensitive drums 1 onto the intermediate transfer belt 9. The secondary transfer roller 69 is a secondary transfer unit configured to transfer (secondarily transfer) the toner images on the intermediate transfer belt 9 onto the recording materials P. The primary transfer rollers 58 are each pressed toward the photosensitive drum 1 through the intermediate transfer belt 9 so as to form a primary transfer portion (primary transfer position) N1 at which the photosensitive drum 1 and the intermediate transfer belt 9 are in contact with each other. The secondary transfer roller 69 is pressed against the secondary transfer opposing roller 59 through the intermediate transfer belt 9 so as to form a secondary transfer portion (secondary transfer position) N2 at which the intermediate transfer belt 9 and the secondary transfer roller 69 are in contact with each other.

The intermediate transfer belt 9 is moved in circulation while being disposed opposite to and in contact with all the photosensitive drums 1. Then, a voltage is applied to the primary transfer rollers 58 so as to primarily transfer the toner images from the photosensitive drums 1 onto the intermediate transfer belt 9. Further, a voltage is applied to the secondary transfer roller 69 so as to secondarily transfer the toner images from the intermediate transfer belt 9 onto the recording materials P.

Next, how a sequence of image forming operations is performed will be described by way of an example of color image formation. In a case of image formation, in each of the image forming portions S, the photosensitive drum 1 is rotated in a direction indicated by an arrow R1 in FIG. 1. The surface of the photosensitive drum 1 thus rotated is uniformly charged by the charging roller 2, and the scanner unit 3 performs selective exposure onto the photosensitive drum 1 thus charged. In this way, the electrostatic latent image is formed on the photosensitive drum 1. The developing roller 25 supplies toner and develops the electrostatic latent image with the toner. In this way, the toner images of the respective colors are formed on the photosensitive drums 1.

In the respective primary transfer portions N1, the toner images of the respective colors on the photosensitive drums 1 are primarily transferred in a superimposed manner sequentially onto the intermediate transfer belt 9 rotated in a direction indicated by an arrow R2 in FIG. 1. At this time, a primary transfer voltage having a polarity opposite to a regular charging polarity of the toner of the toner images is applied to each of the primary transfer rollers 58.

In synchronism with the toner images on the intermediate transfer belt 9, the registration roller pair conveys the recording materials P to the secondary transfer portion N2. Then, in the secondary transfer portion N2, the toner images on the intermediate transfer belt 9 are secondarily transferred onto the recording materials P. At this time, a secondary transfer voltage having a polarity opposite to the regular charging polarity of the toner of the toner images is applied to the secondary transfer roller 69. In this way, a resultant toner image for a color image to be made from the toner images of the four colors is formed on each of the recording materials P.

The recording material P, on which the resultant toner image for the color image is formed, is heated and pressurized in the attaching portion 74. In this way, the resultant toner image is fixed onto the recording material P. After that, the recording material P is delivered onto a delivery portion 75 by a delivery roller 72. In this way, a recorded image is output.

2. Process Cartridge

Figure 2:
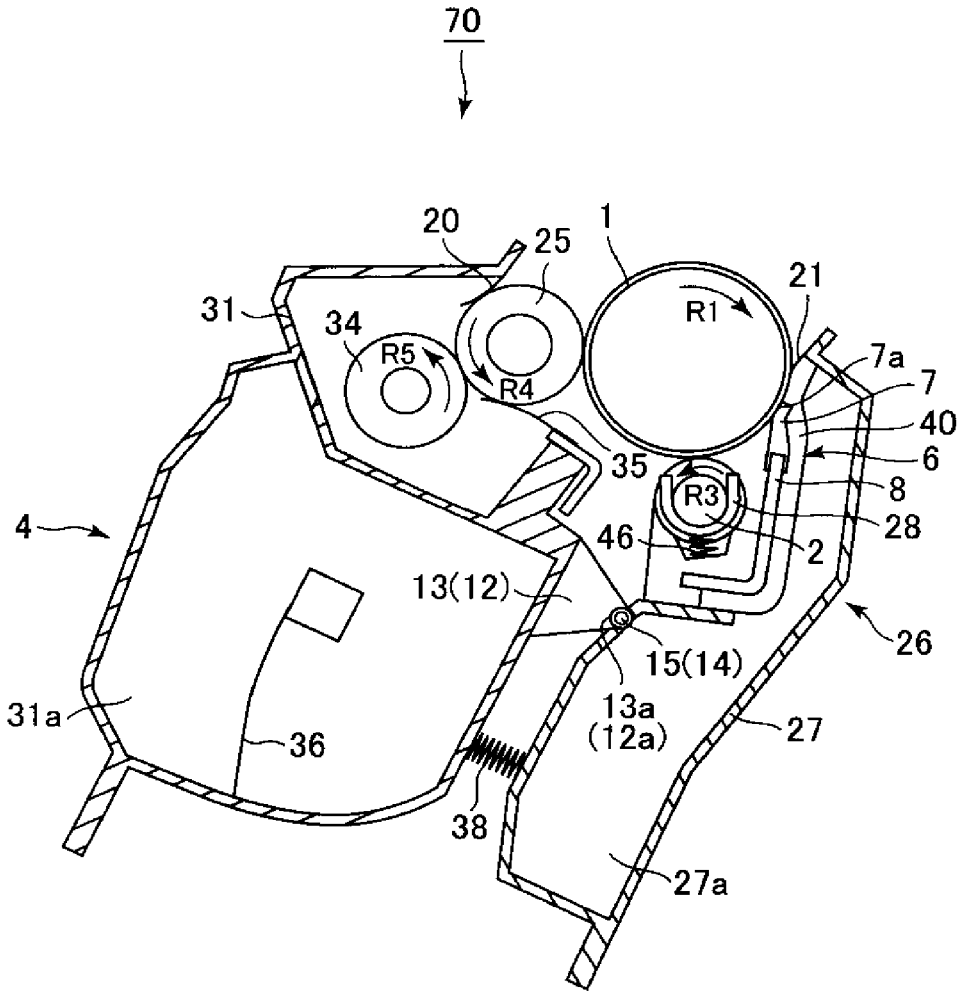
FIG. 2 is a sectional view of a process cartridge according to the embodiment of the present invention.

Next, the process cartridge 70 according to the embodiment will be described in more detail. FIG. 2 is a sectional view of the process cartridge 70.

In the embodiment, the cartridge 70Y, which contains a yellow toner, the cartridge 70M, which contains a magenta toner, the cartridge 70C, which contains a cyan toner, and a cartridge 70K, which contains a black toner, are substantially the same in structure.

The process cartridges 70 each include a cleaning unit 26 and a developing unit 4. Note that, in general, the process cartridge is a unit which is removably mounted to a main body of an electrophotographic image forming apparatus. The process cartridge integrally incorporates an electrophotographic photosensitive member and at least one of the processing units such as a charging unit, a developing unit, and a cleaning unit which act on the electrophotographic photosensitive member. In the present invention, the process cartridge includes at least a cleaning unit according to the present invention.

The cleaning unit 26 includes the photosensitive drum 1, the charging roller 2, the cleaning member 6, and a cleaning frame 27 configured to support those components. In the cleaning unit 26, the charging roller 2 and the cleaning member 6 are disposed in contact with an outer peripheral surface of the photosensitive drum 1.

The cleaning member 6 includes a rubber blade 7 which is a blade-shaped elastic member formed of rubber as an elastic material, and a support member 8 configured to support the rubber blade 7. The rubber blade 7 is brought into abutment with the photosensitive drum 1 in a counter direction with respect to a rotational direction of the photosensitive drum 1. In other words, the rubber blade 7 is brought into abutment with the photosensitive drum 1 in a manner that a tip portion 7*a* thereof is directed to an upstream side in the rotational direction of the photosensitive drum 1. The residual toner removed from the surface of the photosensitive drum 1 by the cleaning member drops into a removed toner chamber 27*a* formed of the cleaning frame 27. Further, at an edge portion of the cleaning frame 27, which is opposed to the photosensitive drum 1, a scooping sheet 21 configured to prevent leakage of the removed toner in the removed toner chamber 27*a* is provided in abutment with the photosensitive drum 1. The scooping sheet 21 is a sheet member made of polyester.

In order to drive and rotate the photosensitive drum 1 in the direction indicated by the arrow R1 in FIG. 2 in accordance with the image forming operation, a driving force of a main body drive motor (not shown) as a drive source is transmitted to the cleaning unit 26.

The charging roller 2 is attached in a rotatable manner to the cleaning unit 26 through charging roller bearings 28 at both end portions in a longitudinal direction of the cleaning frame 27 (substantially parallel to a direction of a rotation axis of the photosensitive drum 1). The charging roller bearings 28 are pressed by respective charging roller pressure members 46 toward the photosensitive drum 1 so that the charging roller 2 is brought into pressure contact with the photosensitive drum 1. Along with the rotation of the photosensitive drum 1, the charging roller 2 is rotated in a direction indicated by an arrow R3 in FIG. 2.

Figure 4:
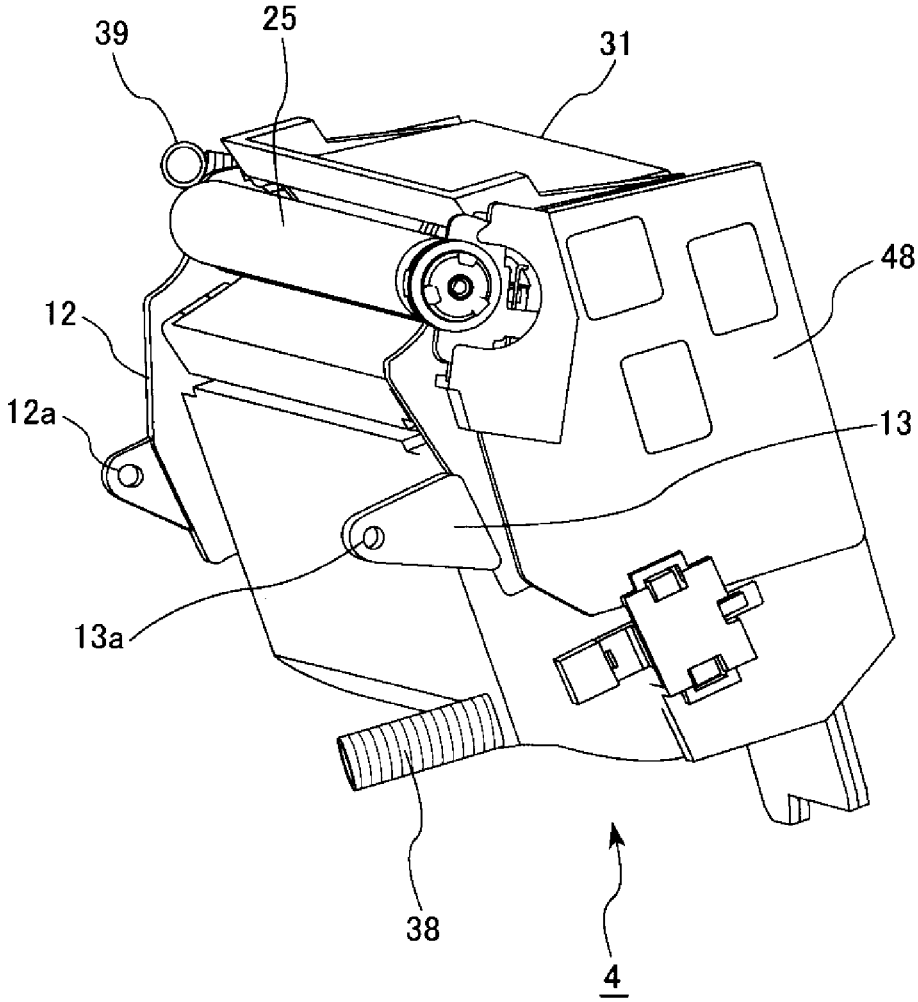
FIG. 4 is a perspective view of a developing unit according to the embodiment of the present invention.

The developing unit 4 includes the developing roller 25 and a developing frame 31 configured to support the developing roller 25. The developing roller 25 is in contact with the photosensitive drum 1 and driven and rotated in a direction indicated by an arrow R4 in FIG. 2. Further, in the developing unit 4, a toner supply roller 34 configured to supply toner to the developing roller 25 and a developing blade 35 configured to regulate a toner layer on the developing roller 25 are arranged in contact with the outer peripheral surface of the developing roller 25. The toner supply roller 34 is driven in contact with the developing roller 25 and rotated in a direction indicated by an arrow R5 in FIG. 2. The developing roller 25 and the toner supply roller 34 are supported in a freely rotatable manner by the developing frame 31 through a developing front bearing 12 and a developing rear bearing 13 fixed respectively on both end portions in a longitudinal direction of the developing frame 31 (substantially parallel to the direction of the rotation axis of the photosensitive drum 1) (FIGS. 2 and 4). Further, at an edge portion of the developing frame 31, which is opposed to the developing roller 25, a blow-out preventing sheet (developing abutment sheet) 20 configured to prevent leakage of toner from the developing frame 31 is provided in abutment with the developing roller 25. Further, a toner containing chamber 31*a* formed of the developing frame includes a toner conveying member 36 configured to agitate toner contained in the toner containing chamber 31*a* and convey the toner to the toner supply roller 34.

Figure 3:
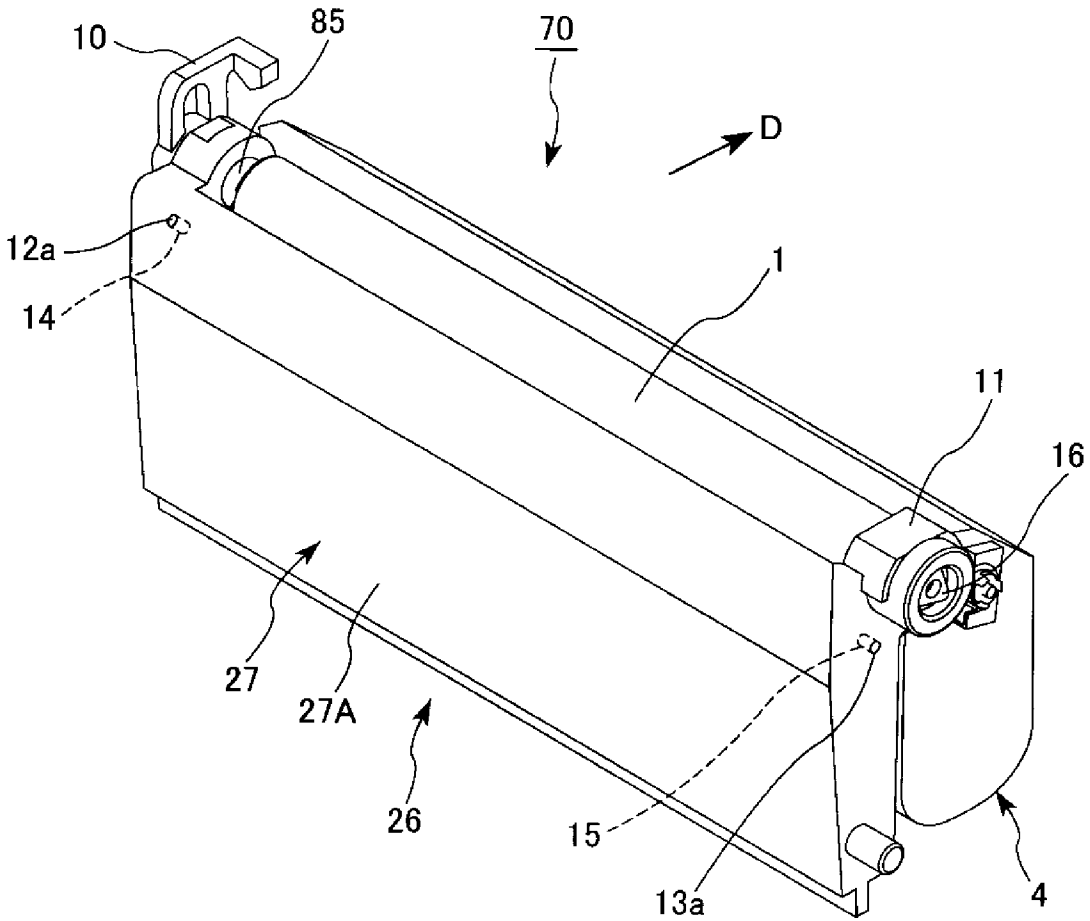
FIG. 3 is a perspective view of the process cartridge according to the embodiment of the present invention.

FIG. 3 is an external perspective view of the process cartridge 70. FIG. 4 is an external perspective view of the developing unit 4.

The developing unit 4 is attached by a front support pin 14 and a rear support pin 15 press-fitted respectively into both the end portions in the longitudinal direction of the cleaning frame 27. With this, the developing unit 4 can be swung with respect to the cleaning unit 26. Further, at both the end portions in the longitudinal direction of the cleaning frame 27, there are respectively provided a drum front bearing 10 and a drum rear bearing 11 configured to support the photosensitive drum 1 in a freely rotatable manner. The drum rear bearing supports a drum coupling 16 coupled to the photosensitive drum 1, and the drum front bearing 10 supports a flange 85. In the embodiment, the drum front bearing 10 and the drum rear bearing 11 (second frame part) are coupled to a cleaning frame main body (first frame part) 27A and integrated therewith. With this, cooperatively with the cleaning frame main body 27A, the drum front bearing 10 and the drum rear bearing 11 form the cleaning frame 27 configured to support the photosensitive drum 1 and the cleaning member 6. Note that, the drum front bearing 10 and the drum rear bearing 11 may be formed integrally with the cleaning frame main body 27A.

The developing unit 4 includes the developing frame 31, and the developing front bearing 12 and the developing rear bearing 13 configured to support the developing roller 25 and the toner supply roller 34 in a freely rotatable manner (FIGS. 2 and 4). The developing unit 4 is urged toward the cleaning unit 26 by a pressure spring 38 provided on the developing frame 31 and a tension spring 39 provided on the developing front bearing 12. The pressure spring 38 and the tension spring 39 are pressure members configured to apply a pressing force to the developing roller 25 so as to bring the developing roller 25 into contact with the photosensitive drum 1 at a time of image formation with the process cartridge 70. The pressure spring 38 as a compression spring is disposed between the cleaning frame 27 and the developing frame 31. Further, the tension spring 39 has both ends hooked respectively to the developing front bearing 12 and the drum front bearing 10. The pressure spring 38 and the tension spring 39 cause the developing unit 4 to be swung with respect to the cleaning unit 26 about respective holes 12*a* and 13*a* of the developing front bearing 12 and the developing rear bearing 13. In this way, the pressing force for bringing the developing roller 25 into abutment with the photosensitive drum 1 is exerted on the developing roller 25.

Note that, in a contact developing process in which the photosensitive drum 1 and the developing roller are brought into contact with each other so as to perform a development, it is preferred that the photosensitive drum 1 be a rigid member, and the developing roller 25 be a roller including an elastic member. Examples of the elastic member include a solid rubber single layer, and a solid rubber layer coated with a resin in order to secure an electric charge giving property of giving an electric charge to toner.

3. Cleaning Unit

Next, how to support the cleaning member 6 of the cleaning unit 26 according to the embodiment will be described in detail.

In the embodiment, in order, for example, to reduce rotational torque of the photosensitive drum 1, the cleaning member 6 which abuts against the photosensitive drum 1 is supported in a pivotable manner by the cleaning frame 27. This is because, when a separate member such as a pin is used as described above for supporting the cleaning member 6 in a pivotable manner, a larger number of components and higher cost thereof are required. In addition, the structure is liable to be complicated.

It is a main object in the embodiment to support the cleaning member in a pivotable manner with a simple structure such as the frame without use of the separate member such as the pin, to thereby achieve reduction in manufacturing cost and to enable easier assembly.

In the following, only one end portion (front end portion) in a longitudinal direction of the process cartridge 70 (substantially parallel to the direction of the rotation axis of the photosensitive drum 1) will be described in detail. Meanwhile, the other end portion (rear end portion), which has substantially the same (substantially symmetrical) structure, is not described unless it is necessary to make specific description.

Figure 5:
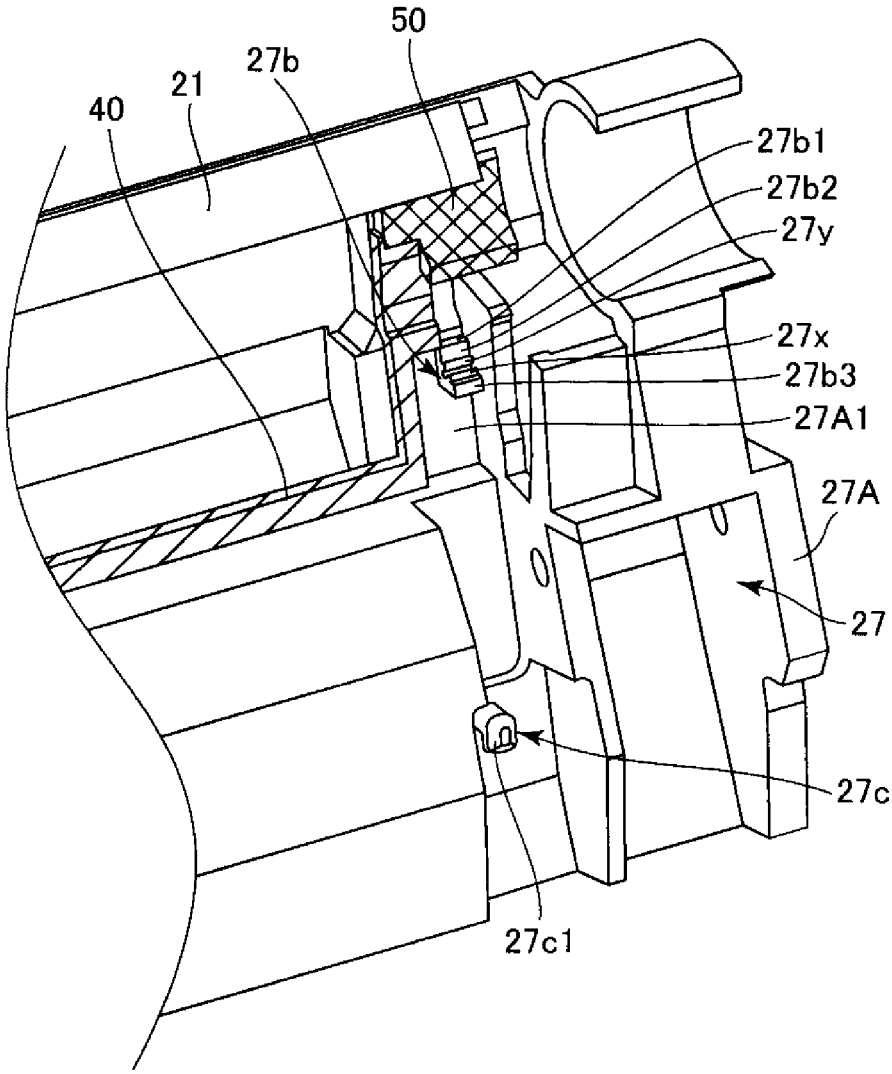
FIG. 5 is a perspective view of a cleaning frame according to the embodiment of the present invention.
Figure 6:
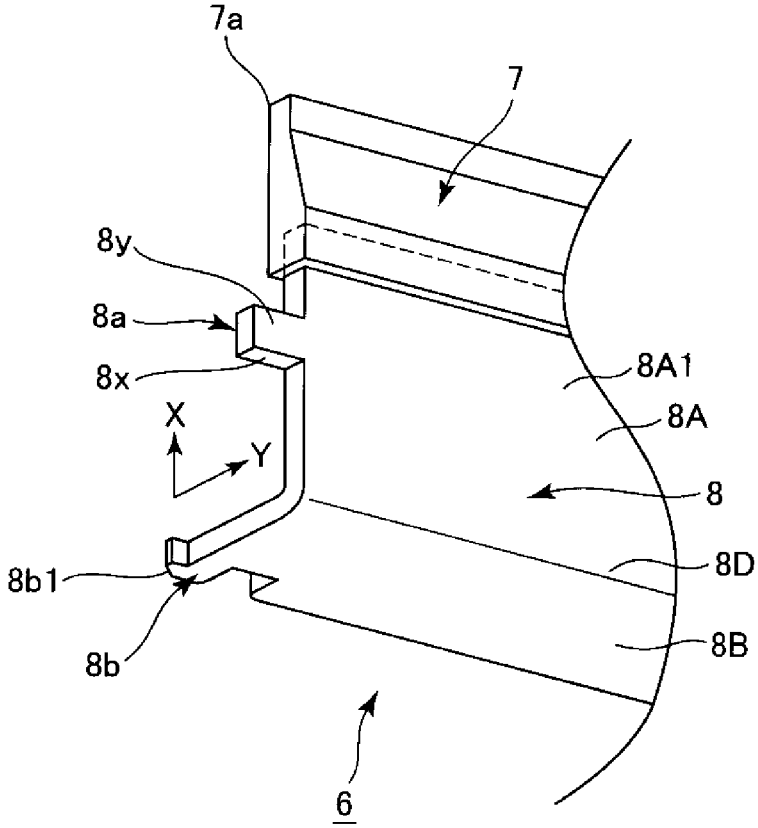
FIG. 6 is a perspective view of a cleaning member according to the embodiment of the present invention.
Figure 7:
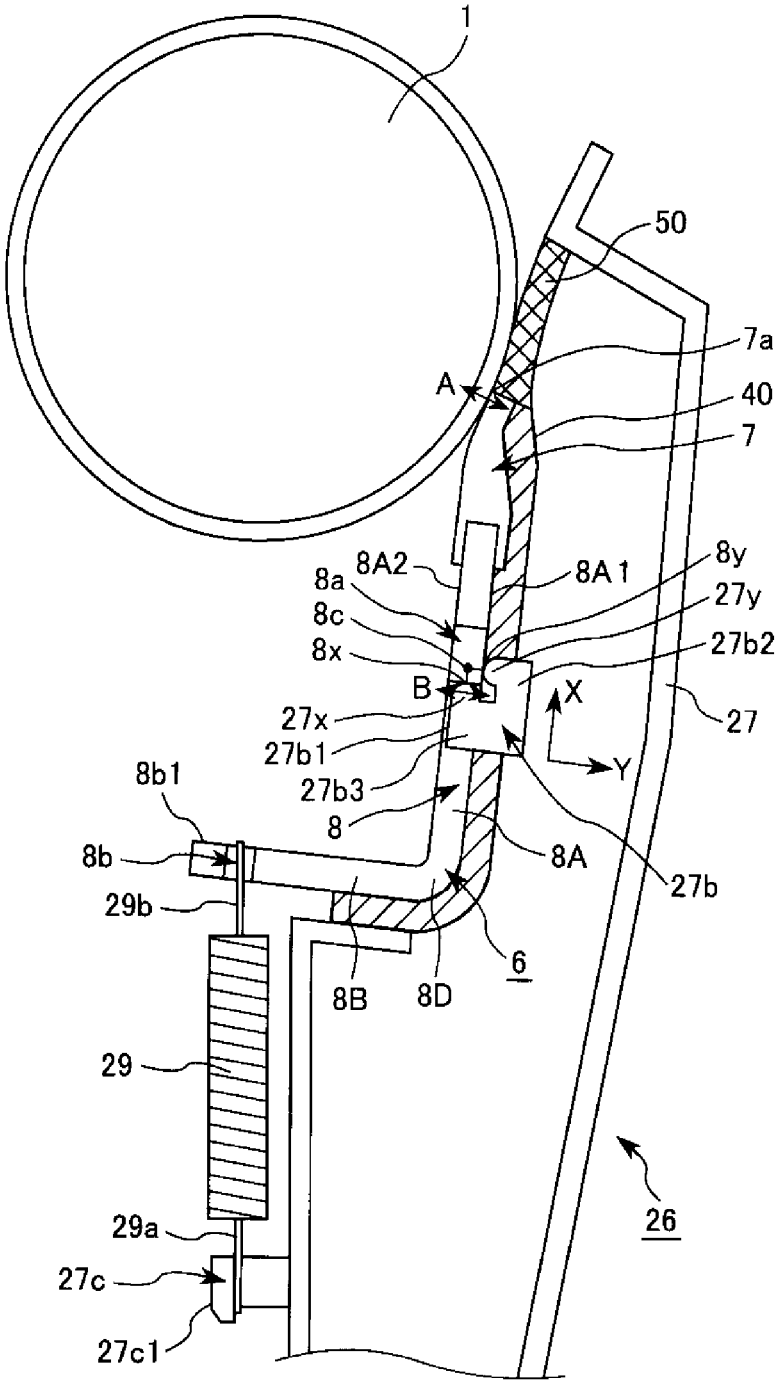
FIG. 7 is a sectional view of a cleaning unit according to the embodiment of the present invention.

FIG. 5 is a perspective view of an inner surface 27A1 of the cleaning frame 27 (in particular, cleaning frame main body 27A). FIG. 6 is a perspective view of one end portion (front end portion) in a longitudinal direction of the cleaning member 6 (substantially parallel to the direction of the rotation axis of the photosensitive drum 1) as viewed from the side of the inner surface 27A1 of the cleaning frame 27. FIG. 7 is a sectional view of a substantial part of the cleaning unit 26.

The cleaning unit 26 includes the rotatable photosensitive drum 1, the cleaning member 6 configured to remove toner from the photosensitive drum 1, and the cleaning frame 27 as a frame configured to support the photosensitive drum 1 and the cleaning member 6. The cleaning member 6 includes the elastic member 7 which abuts against the photosensitive drum 1, and the support member 8 configured to support the elastic member 7. In the embodiment, as described above, the elastic member 7 is a rubber blade formed of rubber as an elastic material. Further, the support member 8 used in the embodiment has an outer shape formed by punching out a sheet metal, which is a flat metal plate material, through press working. Urethane rubber can be suitably used as the rubber material for the rubber blade 7. Further, a plated steel plate can be suitably used as a material for the support member 8. Alternatively, a stainless steel plate may be used.

In particular, in the embodiment, as illustrated in FIGS. 6 and 7, the support member 8 is formed by bending a single continuous sheet metal punched out through press working, at a predetermined position (bent part) 8D in a lateral direction thereof, over the entire region in a longitudinal direction of the support member 8. With this, the support member 8 is formed into a substantial L-shape in cross-section as viewed in the direction of the rotation axis of the photosensitive drum 1. In the embodiment, the bent part 8D is curved into a circular-arc shape in cross-section as viewed in the direction of the rotation axis of the photosensitive drum 1. In other words, the support member 8 includes a plate-shaped main part 8A substantially parallel to the direction of the rotation axis of the photosensitive drum 1, and a strengthening part 8B bent in a direction in which the strengthening part 8B intersects with the main part 8A at the bent part 8D. In the embodiment, the strengthening part 8B is bent to project toward the photosensitive drum 1 with respect to the main part 8A. With this, at the time of attachment of the cleaning frame 27 to the photosensitive drum 1, deflection in the longitudinal direction of the cleaning member 6 is suppressed. Note that, in the embodiment, the strengthening part 8B is bent in a direction substantially orthogonal to the main part 8A. However, the present invention is not limited thereto. Further, a side surface of the main part 8A of the support member 8, which is on the side of the inner surface 27A1 of the cleaning frame 27, is defined as a first side surface 8A1, and an opposite side surface of the main part 8A of the support member 8, which is on the side of the photosensitive drum 1, is defined as a second side surface 8A2. The rubber blade 7 is coupled to and integrated with an edge portion of the support member 8 opposite to the bent part 8D in the lateral direction of the main part 8A of the support member 8. The rubber blade 7 is provided continuously over the entire region in a longitudinal direction of the main part 8A of the support member 8.

As illustrated in FIG. 5, the cleaning frame 27 includes a cleaning member support portion (hereinafter also simply referred to as "support portion") 27*b* configured to support the cleaning member 6. The support portion 27*b* includes a first support portion 27*y* and a second support portion 27*x* which abut against the cleaning member 6. The support portion 27*b* will be described in further detail below.

The cleaning frame 27 also includes a sealing member 40 configured to seal a gap between the cleaning frame 27 and the cleaning member 6. Specifically, the sealing member 40 seals a gap between the cleaning frame 27 and the rubber blade 7 and a gap between the cleaning frame 27 and the support member 8 near each of the end portions in the longitudinal direction of the cleaning member 6. Further, the sealing member 40 also seals a gap between the support member 8 and the cleaning frame 27 near an edge portion of the main part 8A of the support member 8 on a side opposite to the rubber blade 7 in the lateral direction of the support member 8. Further, the cleaning frame 27 includes an end portion sealing member 50 configured to seal a gap among the cleaning frame 27, the cleaning member 6, and the photosensitive drum 1. Specifically, the end portion sealing member 50 seals a gap between the photosensitive drum 1 and the cleaning frame 27 and a gap between the rubber blade 7 and the cleaning frame 27 at a corner portion of the tip portion 7*a* of the rubber blade 7 near the end portion in the longitudinal direction of the cleaning member 6.

The sealing member 40 is an elastic sealing member made of polyurethane foam or elastomer. Meanwhile, each of the end portion sealing members 50 is a sealing member made of pile, nonwoven fabric, or felt.

Further, the cleaning frame 27 includes a boss 27*c* as a frame side urging member attaching portion configured to attach a tension spring 29 (FIG. 7) as an urging member described below. In the embodiment, the boss 27*c* is a substantially columnar protrusion provided upright on the inner surface 27A1 of the cleaning frame 27. The boss 27*c* has a distal end provided with a claw-like engagement portion 27*c*1 configured to engage one end portion 29*a* of the tension spring 29.

Meanwhile, as illustrated in FIG. 6, an end portion in the longitudinal direction of the main part 8A of the support member 8 is provided with a frame abutment portion (hereinafter also simply referred to as "abutment portion") 8*a* which is projected to abut against the cleaning frame 27. The cleaning member 6 abuts against the support portion 27*b* of the cleaning frame 27 at the abutment portion 8*a*, and is supported by the cleaning frame in a pivotable manner (swingable manner) about the abutment portion 8*a* as a pivot axis.

In the embodiment, the abutment portion 8*a* is formed into a substantially rectangular parallelepiped shape in which one side surface of the abutment portion 8*a* is continuous with a side surface of the end portion in the longitudinal direction of the main part 8A of the support member 8. The one side surface of side surfaces of the abutment portion 8*a*, which is flush with the first side surface 8A1 of the main part 8A of the support member 8, serves as a first abutment portion 8*y* described below. Further, a side surface of the side surfaces of the abutment portion 8*a* opposite to the rubber blade 7 in the lateral direction of the main part 8A serves as a second abutment portion 8*x* described below.

As viewed in the direction of the rotation axis of the photosensitive drum 1, a direction toward the tip portion 7*a* of the rubber blade 7 along an axis of the main part 8A of the support member 8 (substantially parallel to the first side surface 8A1 or the second side surface 8A2) is defined as an X direction. Further, as viewed in the direction of the rotation axis of the photosensitive drum 1, a direction perpendicular to the X direction and toward a side opposite to the photosensitive drum 1 with respect to the cleaning member 6 is defined as a Y direction. Still further, a direction directly opposite to the X direction is defined as a −X direction, and a direction directly opposite to the Y direction is defined as a −Y direction. As viewed in the direction of the rotation axis of the photosensitive drum 1, a first axis extending from the abutment portion 8*a* to the rubber blade 7 is a direction along the X direction. Further, a second axis substantially orthogonal to the first axis is a direction along the Y direction.

The abutment portion 8*a* includes the first abutment portion 8*y* which abuts against the first support portion 27*y* of the support portion 27*b*, and the second abutment portion 8*x* which abuts against the second support portion 27*x* of the support portion 27*b*. In the embodiment, the first abutment portion 8*y* is formed of a surface directed in the Y direction of the abutment portion 8*a*, and the second abutment portion 8*x* is formed of a surface directed in the −X direction of the abutment portion 8*a*.

In this way, the support member 8 has the abutment portion 8*a* provided on each of both the end portions of the support member 8 in the direction along the direction of the rotation axis of the photosensitive drum 1. The abutment portion 8*a* abuts against the cleaning frame 27 at a corresponding one of both the end portions of the cleaning frame 27. The abutment portion 8*a* has the first abutment portion 8*y* and the second abutment portion 8*x* which are formed of respective surfaces extending in directions intersecting with each other. As viewed in the direction of the rotation axis of the photosensitive drum 1, the first abutment portion 8*y* is directed to a side opposite to the side of the photosensitive drum 1 with respect to the first axis, and the second abutment portion 8*x* is directed to an opposite side which is opposite to the side of the elastic member 7 with respect to the second axis.

As described above, in the embodiment, the support member 8 is formed of a sheet metal (blank) punched out through press working. Thus, the second abutment portion 8*x* is formed of a machined surface (cut edge surface) obtained through the press working. In this case, the surfaces of the first abutment portion 8*y* and the second abutment portion 8*x* are substantially orthogonal to each other. Note that, when desired, the surfaces of the first abutment portion 8*y* and the second abutment portion 8*x* may intersect with each other at other angle.

Further, the support member 8 of the cleaning member 6 includes an urging member attaching portion (hereinafter also simply referred to as "attaching portion") 8*b* configured to attach the tension spring 29. In the embodiment, the attaching portion 8*b* is provided at a distal end portion of an end portion in a longitudinal direction of the strengthening part 8B of the support member 8. The attaching portion 8*b* has a distal end provided with a claw-like engagement portion 8*b*1 configured to engage the other end portion 29*b* of the tension spring 29. With this, in the embodiment, the tension spring 29 exerts an urging force on an acting portion projected from the main part 8A of the support member 8 toward the photosensitive drum 1 along a direction intersecting with the main part 8A of the support member 8 (in the embodiment, direction substantially orthogonal to the main part 8A).

The configuration described above will be described below in further detail with reference to FIG. 7 illustrating a state in which the cleaning member 6 is in abutment with the photosensitive drum 1 while the process cartridge 70 is maintained in a stationary state and rotation of the photosensitive drum 1 is stopped.

In the cleaning frame 27, the first support portion 27*y* and the second support portion 27*x* are positioned opposite to the first abutment portion 8*y* and the second abutment portion 8*x* of the cleaning member 6, respectively. The first support portion 27*y* is brought into contact with the first abutment portion 8*y* and receives a Y direction force which is exerted on the cleaning member 6. The second support portion 27*x* is brought into contact with the second abutment portion 8*x* and receives a −X direction force which is exerted on the cleaning member 6.

In this way, the cleaning frame 27 has the support portions 27*b* which abut against the abutment portions 8*a* provided on both the end portions of the support member 8 in the direction along the direction of the rotation axis of the photosensitive drum 1. The support portion 27*b* includes the first support portion 27*y* which abuts against the first abutment portion 8*y* and the second support portion 27*x* which abuts against the second abutment portion 8*x*, and supports the cleaning member 6 in a pivotable manner about the abutment portion 8*a* as a pivot axis.

A pivot center (swing center) 8*c* of the cleaning member 6 substantially corresponds to an intersection of a straight line extending in the −Y direction from a contact position (tangent point) between the first support portion 27*y* and the first abutment portion 8*y*, and a straight line extending in the X direction from a contact position between the second support portion 27*x* and the second abutment portion 8*x*. In other words, as viewed in the direction of the rotation axis of the photosensitive drum 1, the pivot center 8*c* corresponds to an intersection of a straight line extending along the above-mentioned second axis from the contact position between the first abutment portion 8*y* and the first support portion 27*y*, and a straight line extending along the above-mentioned first axis from the contact position between the second abutment portion 8*x* and the second support portion 27*x*.

Further, in order to bring the rubber blade 7 of the cleaning member 6 into abutment with the photosensitive drum 1, the other end portion 29*b* of the tension spring 29 is fixed to the attaching portion 8*b* of the support member 8, and the one end portion 29*a* of the tension spring 29 is fixed to the boss 27*c* of the cleaning frame 27. The urging force of the tension spring 29 applies a rotational moment about the pivot center 8*c* to the cleaning member 6. With this, the tip portion 7*a* of the rubber blade 7 is brought into abutment with the photosensitive drum 1.

In this way, the cleaning unit 26 has the tension spring 29 serving as an urging member configured to urge the cleaning member 6 in a direction in which the rubber blade 7 is brought into contact with the photosensitive drum 1 by pivoting the cleaning member 6 about the abutment portion 8*a* as a pivot axis.

When the photosensitive drum 1 is rotated, for example, at the time of image formation, the rubber blade 7 of the cleaning member 6 is moved in directions indicated by arrows A in FIG. 7 due to, for example, vibration of the photosensitive drum 1. In that case, the cleaning member 6 pivots about the abutment portion 8*a* as a pivot axis. Specifically, the second abutment portion 8*x* of the abutment portion 8*a* pivots about the pivot center 8*c* in directions indicated by arrows B in FIG. 7.

In the embodiment, the first support portion 27*y* and the second support portion 27*x* are each formed into a circular-arc shape in cross-section as viewed in the direction of the rotation axis of the photosensitive drum 1. In further detail, in the embodiment, the support portion 27*b* of the cleaning frame 27 is formed on a rack portion 27*b*1 which has a substantial L-shape in cross-section as viewed in the direction of the rotation axis of the photosensitive drum 1 and is projected from the inner surface 27A1 of the cleaning frame 27. The first support portion 27*y* is formed on a vertical rack portion 27*b*2 along the X direction of the rack portion 27*b*1. The second support portion 27*x* is formed on a horizontal rack portion 27*b*3 along the −Y direction of the rack portion 27*b*1. The cleaning member 6 is supported at one point on an outer peripheral surface of the first support portion 27*y* and one point on an outer peripheral surface of the second support portion 27*x* in cross-section as viewed in the direction of the rotation axis of the photosensitive drum 1. In other words, along lines on the respective outer peripheral surfaces of the first support portion 27*y* and the second support portion 27*x*, which each extend along the direction of the rotation axis of the photosensitive drum 1, the first support portion 27*y* and the second support portion 27*x* are in contact with the first abutment portion 8*y* and the second abutment portion 8*x*, respectively. In this way, when the first support portion 27*y* and the second support portion 27*x* are each formed into a circular-arc shape in cross-section, contact resistances with respect to the abutment portion 8*a* can be reduced. As a result, the cleaning member 6 can be more smoothly moved.

Figure 8:
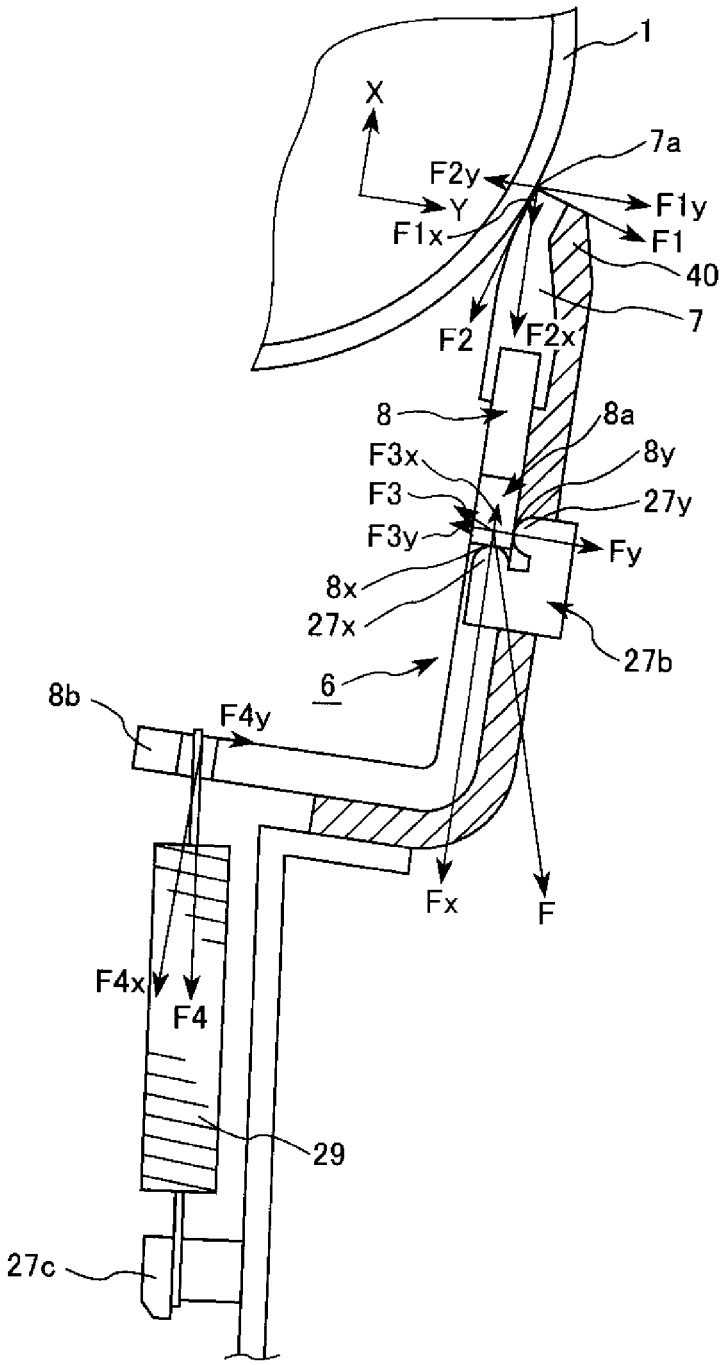
FIG. 8 is a partial sectional view of the cleaning unit according to the embodiment of the present invention, for illustrating a force exerted on the cleaning member.

Next, a force F which is exerted on the cleaning member 6 will be described with reference to FIG. 8. FIG. 8 is a view of a substantial part of the cleaning unit 26, for illustrating the force F exerted on the cleaning member 6.

The force F which is exerted on the cleaning member 6 includes a drum abutment force F1 generated by bringing the rubber blade 7 into abutment with the photosensitive drum 1 by a desired pressing force, a frictional force F2 generated by driving the photosensitive drum 1, a repulsive force F3 generated by the sealing member 40, and a spring tension F4 generated by the tension spring 29.

The force F which is exerted on the cleaning member 6 also includes a force Fx in the X direction as a resultant force Fx of an X component Fix of the drum abutment force F1, an X component F2*x* of the frictional force F2, an X component F3*x* of the repulsive force F3, and an X component F4*x* of the spring tension F4, which is expressed as follows: Fx=F1*x*+F2*x*+F3*x*+F4*x*. Note that, when the rotation of the photosensitive drum 1 is stopped, the X component F2*x* is zero.

On the other hand, the force F which is exerted on the cleaning member 6 also includes a force Fy in the Y direction as a resultant force Fy of a Y component Fly of the drum abutment force F1, a Y component F2*y* of the frictional force F2, a Y component F3*y* of the repulsive force F3, and a Y component F4*y* of the spring tension F4, which is expressed as follows: Fy=F1*y*+F2*y*+F3*y*+F4*y*. Note that, when the rotation of the photosensitive drum 1 is stopped, the Y component F2*y* is zero.

In order that the force F as a total resultant force of the resultant force Fx of the X components F1*x* to F4*x* and the resultant force Fy of the Y components F1*y* to F4*y* is generated in a direction of bringing the first abutment portion 8*y* and the second abutment portion 8*x* into abutment with the first support portion 27*y* and the second support portion 27*x*, respectively, the resultant force Fx of the X components F1*x* to F4*x* and the resultant force Fy of the Y components F1*y* to F4*y* are set. For example, the total resultant force F can be adjusted through adjustment of tension or a pulling direction of the tension spring 29. With the total resultant force F, the cleaning member 6 can be stably supported by the cleaning frame 27. In other words, through such adjustment of the total resultant force F which is exerted on the cleaning member 6, the cleaning member 6 can be pivoted in a state in which the first abutment portion 8*y* and the second abutment portion 8*x* are in continuous abutment with the first support portion 27*y* and the second support portion 27*x*, respectively, in use of the process cartridge 70.

In the embodiment, the repulsive force F3 generated by the sealing member 40 is taken into account as a component of the total resultant force F for supporting the cleaning member 6. However, for example, when the repulsive force F3 by the sealing member 40 is small, the repulsive force F3 may be ignored. In such a case, in order to seal the gaps between the cleaning member 6 and the cleaning frame 27, after the cleaning member 6 is assembled to the cleaning frame 27, expandable urethane foam may be injected and used as a sealing member. In this case, a repulsive force applied from the sealing member to the cleaning member 6 is minute, and hence the cleaning member 6 can be supported without taking the repulsive force F3 generated by the sealing member 40 into account. Further, in the embodiment, an influence of a weight of the cleaning member 6 itself on the total resultant force F; specifically, on each of the drum abutment force F1, the frictional force F2, the repulsive force F3, and the spring tension F4 is ignorable. However, in some cases, it is necessary to adjust the total resultant force F while taking the weight of the cleaning member 6 itself into account.

Figure 9:
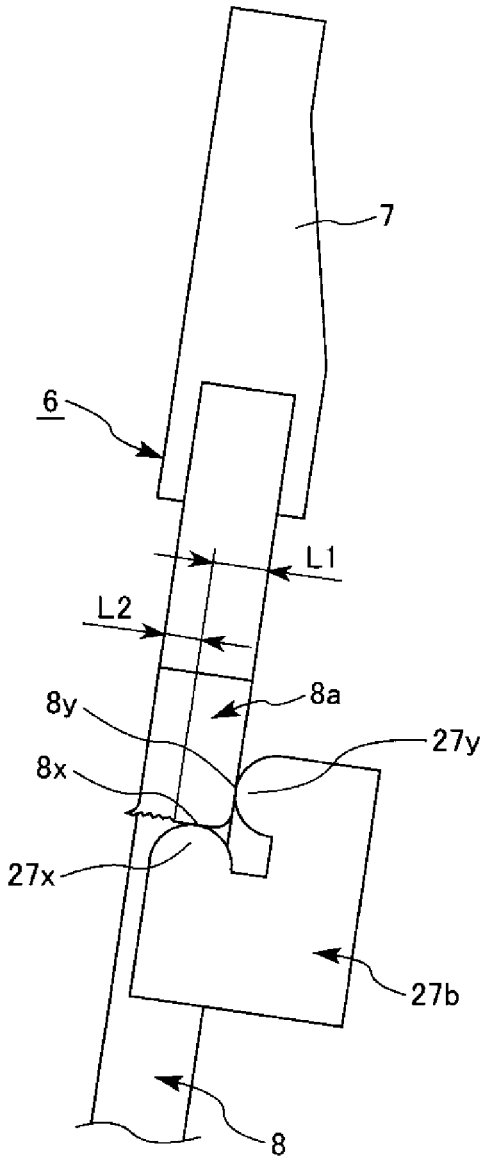
FIG. 9 is a partial sectional view of the cleaning unit according to the embodiment of the present invention.

In addition, as illustrated in FIG. 9, the abutment portion 8*a* is formed through press working (blanking) on a sheet metal. Thus, the side surface as the second abutment portion 8*x* of the abutment portion 8*a* opposite to the second support portion 27*x* involves a shear surface zone L1 and a fracture surface zone L2. In the embodiment, the second support portion 27*x* is brought into abutment with a part of the second abutment portion 8*x*, which corresponds to the shear surface zone L1. This is because, normally, dimensions of a machined surface of the sheet metal, which is obtained through the press working, are defined based on the shear surface zone. Thus, the shear surface zone L1 corresponding to the part of the second abutment portion 8*x* tends to be formed with high dimensional accuracy, and hence performance of the cleaning member 6 can be stabilized. Further, a surface roughness of the machined surface of the sheet metal, which is obtained through the press working, is smaller in the shear surface zone L1 than in the fracture surface zone L2. Thus, when the second support portion 27*x* is brought into abutment with the shear surface zone L1, a support position of the cleaning member 6 is stabilized, and the second support portion 27*x* is prevented from being ground.

Figure 10:
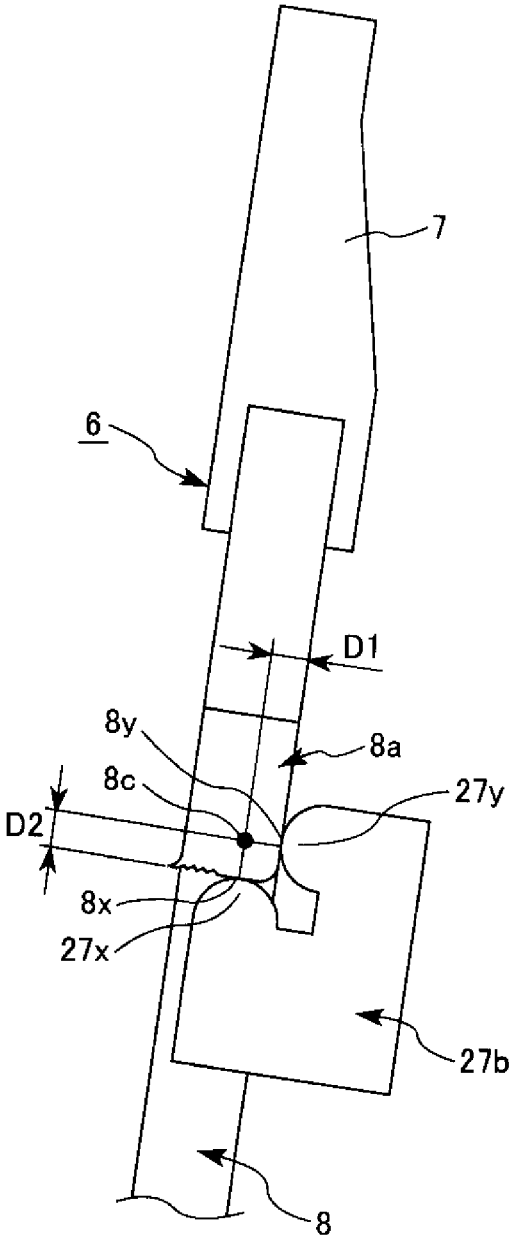
FIG. 10 is a partial sectional view of the cleaning unit according to the embodiment of the present invention.

Further, FIG. 10 illustrates a distance D1 from the contact position between the first abutment portion 8*y* and the first support portion 27*y* to the above-mentioned pivot center 8*c*, and a distance D2 from the contact position between the second abutment portion 8*x* and the second support portion 27*x* to the above-mentioned pivot center 8*c*. The distance D1 and the distance D2 are set to be substantially equal to each other (D1≈D2). In other words, the first support portion 27*y* and the second support portion 27*x* are arranged so that the distance D1 and the distance D2 satisfy this relationship. With such an arrangement, even when the cleaning member 6 is pivoted due to, for example, vibration of the photosensitive drum 1, for example, at the time of image formation, a displacement amount which causes movement of the pivot center 8*c* in the abutment portion 8*a* can be suppressed to a minimum.

Figure 11:
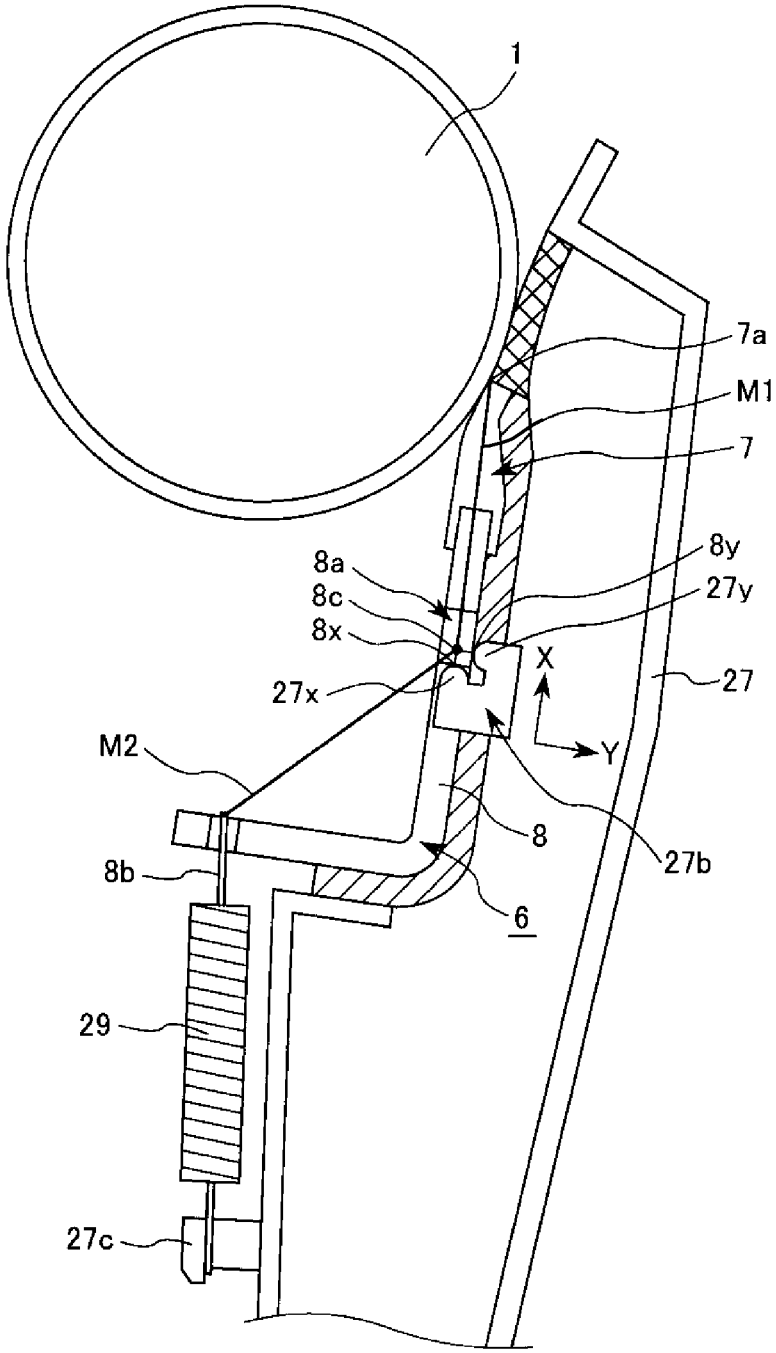
FIG. 11 is a sectional view of the cleaning unit according to the embodiment of the present invention.

Further, FIG. 11 illustrates a distance M1 from the above-mentioned pivot center 8*c* to the tip portion 7*a* of the rubber blade 7, and a distance M2 from the above-mentioned pivot center 8*c* to the attaching portion (acting portion which is urged by the urging member) 8*b* of the support member 8. The distance M1 and the distance M2 are set to be substantially equal to each other (M1≈M2). In other words, the tip portion 7*a* of the rubber blade 7, the above-mentioned pivot center 8*c*, and the attaching portion 8*b* are arranged so that the distance M1 and the distance M2 satisfy this relationship. With such an arrangement, variation in abutment pressure of the cleaning member 6 with respect to the photosensitive drum 1 due to fluctuations in tension of the tension spring 29 can be suppressed. Simultaneously, the cleaning member 6 can be downsized in cross-section as viewed in the direction of the rotation axis of the photosensitive drum 1.

When the distance M1 is larger than the distance M2 (M1>M2), the cleaning member 6 can be thinned in the Y direction. However, it is necessary to increase the urging force so that the rubber blade 7 is brought into abutment with the photosensitive drum 1 by a desired pressing force, in other words, to increase a spring force of the tension spring 29. Thus, it may be necessary to increase a thickness of the sheet metal of the support member 8 configured to support the tension spring 29. Further, it may be also necessary to increase a strength of the support portion 27*b* of the cleaning frame 27. However, those necessities may leads to a cost increase. Meanwhile, when the distance M1 is smaller than the distance M2 (M1<M2), the spring force of the tension spring 29 can be reduced. However, it is necessary to increase a projecting amount of the attaching portion 8*b* from the main part 8A of the support member 8, and hence it is necessary to increase a size in the projecting direction of the process cartridge 70. As a result, the apparatus main body 100A may increase in size. Meanwhile, when the structures satisfying the relationship of M1≈M2 are set as described above, the process cartridge 70 is well-balanced in size and strength. Thus, in the embodiment, the structures satisfying the relationship of M1≈M2 are employed.

4. Assembly Procedure

Figure 12:
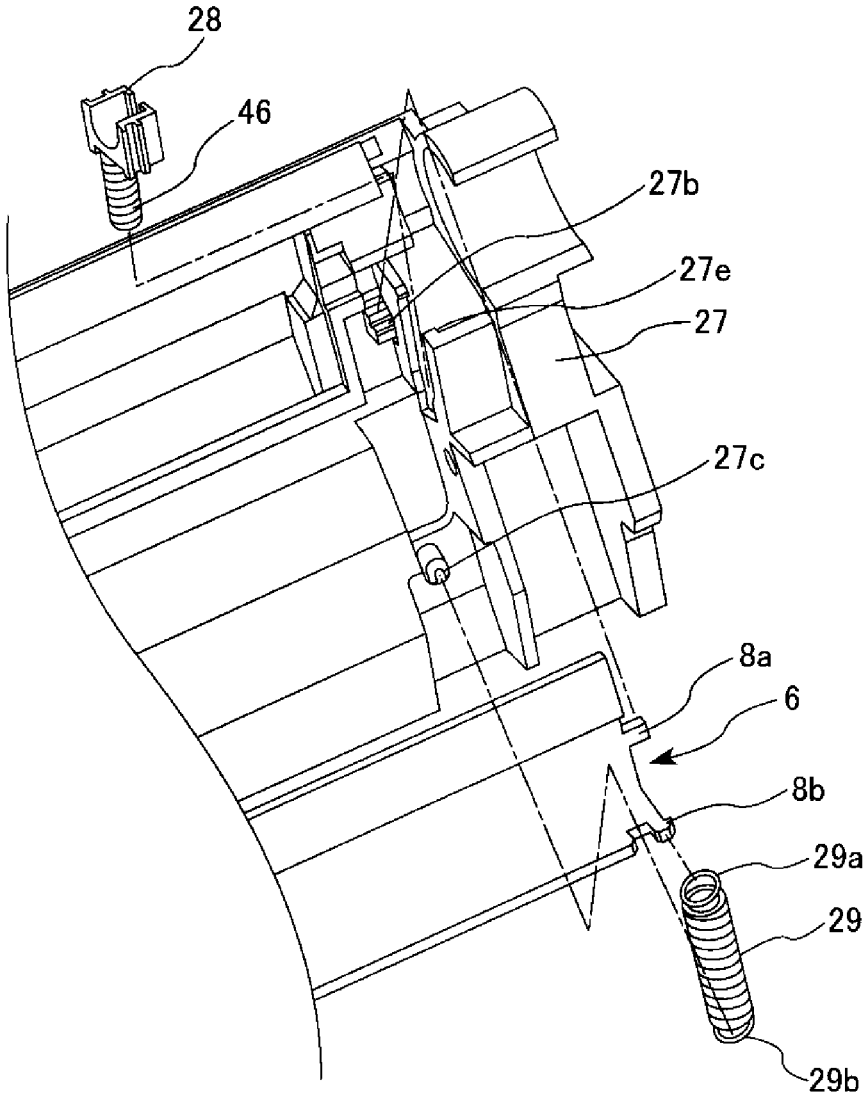
FIG. 12 is a partially exploded perspective view of the cleaning unit according to the embodiment of the present invention.
Figure 13:
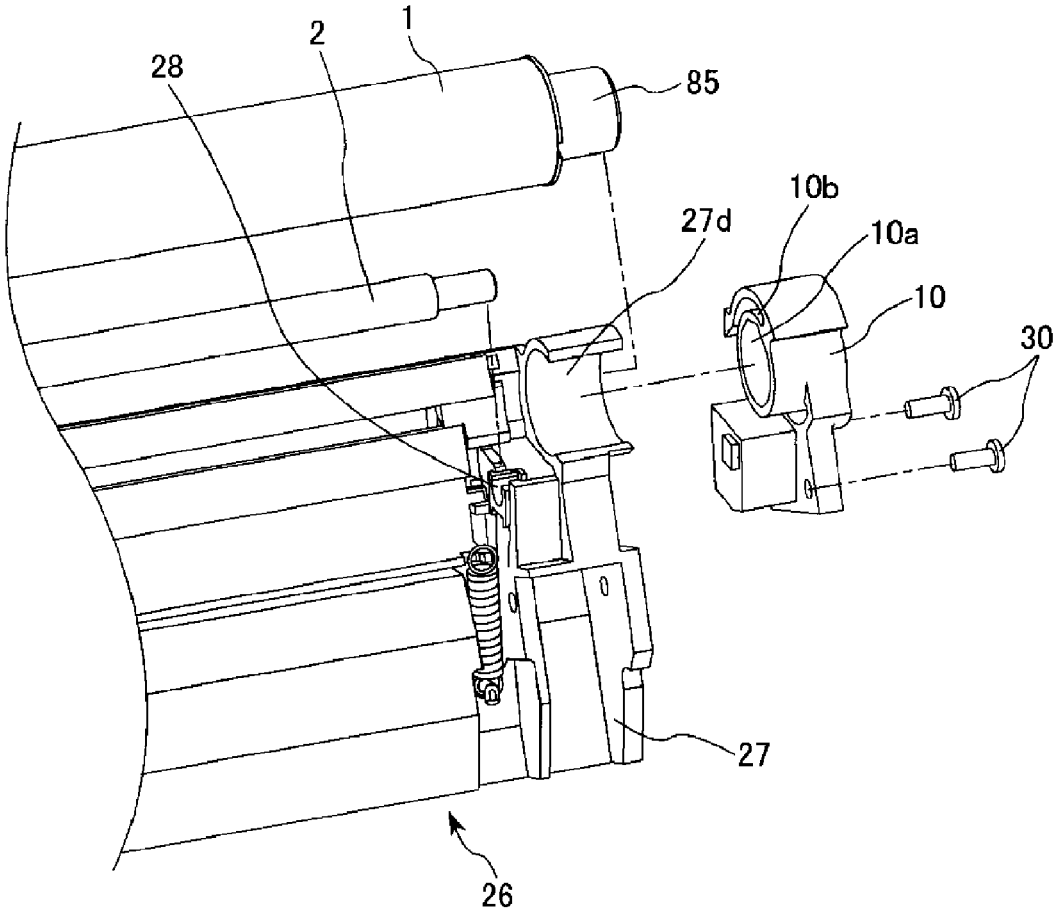
FIG. 13 is a partially exploded perspective view of the cleaning unit according to the embodiment of the present invention.

Next, a procedure for assembling the cleaning unit 26 according to the embodiment will be described. FIGS. 12 and 13 are partially exploded perspective views of the cleaning unit 26, for illustrating the procedure for assembling the cleaning unit 26.

As illustrated in FIG. 12, first, the cleaning member 6 is temporarily set in a manner that the abutment portion 8*a* of the cleaning member 6 abuts against the support portion 27*b* of the cleaning frame 27.

Next, the charging roller bearing 28 and the charging roller pressure member 46 are mounted to a receiving portion 27*e* of the cleaning frame 27 (FIG. 12). Then, the charging roller 2 is mounted to the charging roller bearing 28. Thus, the charging roller 2 can be fixed to the cleaning frame 27 (FIG. 13).

Next, as illustrated in FIG. 13, the flange 85 of the photosensitive drum 1 is temporarily set to a drum positioning portion 27*d* of the cleaning frame 27. The drum positioning portion 27*d* has an inner diameter dimension larger than an outer diameter dimension of the flange 85 of the photosensitive drum 1. In this way, the photosensitive drum 1 is temporarily positioned to the cleaning frame 27.

Next, the drum front bearing 10 is mounted to the cleaning frame 27 in the direction of the rotation axis of the photosensitive drum 1. The drum front bearing 10 includes a rotary shaft support portion 10*a* for the photosensitive drum 1. With this, when the drum front bearing 10 is attached to the cleaning frame 27, the photosensitive drum 1 and the rotary shaft support portion 10*a* are positioned with respect to each other. A bearing positioning portion 10*b* of the drum front bearing 10 and the drum positioning portion 27*d* of the cleaning frame 27 are each formed to have dimensions so as to be fitted to each other. Through engagement of those portions, the drum front bearing 10 is positioned with respect to the cleaning frame 27. Further, the drum front bearing 10 and the cleaning frame 27 respectively include positioning units (not shown) configured to position the drum front bearing and the cleaning frame 27 in a sectional direction (rotational direction) substantially orthogonal to the direction of the rotation axis of the photosensitive drum 1. Through engagement of those units, the drum front bearing and the cleaning frame 27 are positioned in the sectional direction.

In this state, the drum front bearing 10 and the cleaning frame 27 are fixed to each other with fixing units such as screws 30. With this, assembling of the drum front bearing 10 to the cleaning frame 27 is completed.

Lastly, the tension spring 29 is stretched between the attaching portion 8*b* of the cleaning member 6 and the boss 27*c* of the cleaning frame 27 (FIGS. 12 and 13).

The procedure for assembling the cleaning unit 26 will be described with a focus only on one end portion (front end portion) in a longitudinal direction of the cleaning unit 26. However, the same procedure as above is synchronously performed also on the other end portion (rear end portion) of the cleaning unit 26. Note that, at the other end portion (rear end portion) of the cleaning unit 26, the drum rear bearing 11 is attached to the cleaning frame 27 by the same method as above.

With this, assembling the cleaning unit 26 is completed, and the cleaning member 6 abuts against the photosensitive drum 1 by a predetermined pressure. In this way, preparation of cleaning is completed.

As described above, according to the embodiment, the cleaning member can be supported in a pivotable manner with a simple structure such as the frame without use of the separate member such as the pin, to thereby achieve reduction in manufacturing cost and to enable easier assembly.

Further, in the embodiment, the support portion 27*b* of the cleaning frame 27 is made of plastic, and integrated with the cleaning frame 27 (specifically, cleaning frame main body 27A). Further, the abutment portion 8*a* of the cleaning member 6 is formed simultaneously with the press working in which a sheet metal is punched out to form the support member 8 of the cleaning member 6. Thus, according to the embodiment, the numbers of manufacturing steps for the cleaning frame 27 as a support structure for the cleaning member 6, and the cleaning member 6 itself are small, which is advantageous in reduction in manufacturing cost and stabilization of manufacturing accuracy.

Note that, as described above in the embodiment, the first support portion 27*y* and the second support portion 27*x* of the support portion 27*b* of the cleaning frame 27 are each formed into the circular-arc shape in cross-section as viewed in the direction of the rotation axis of the photosensitive drum 1. However, the shape of the support portion 27*b* is not limited thereto.

Figure 14:
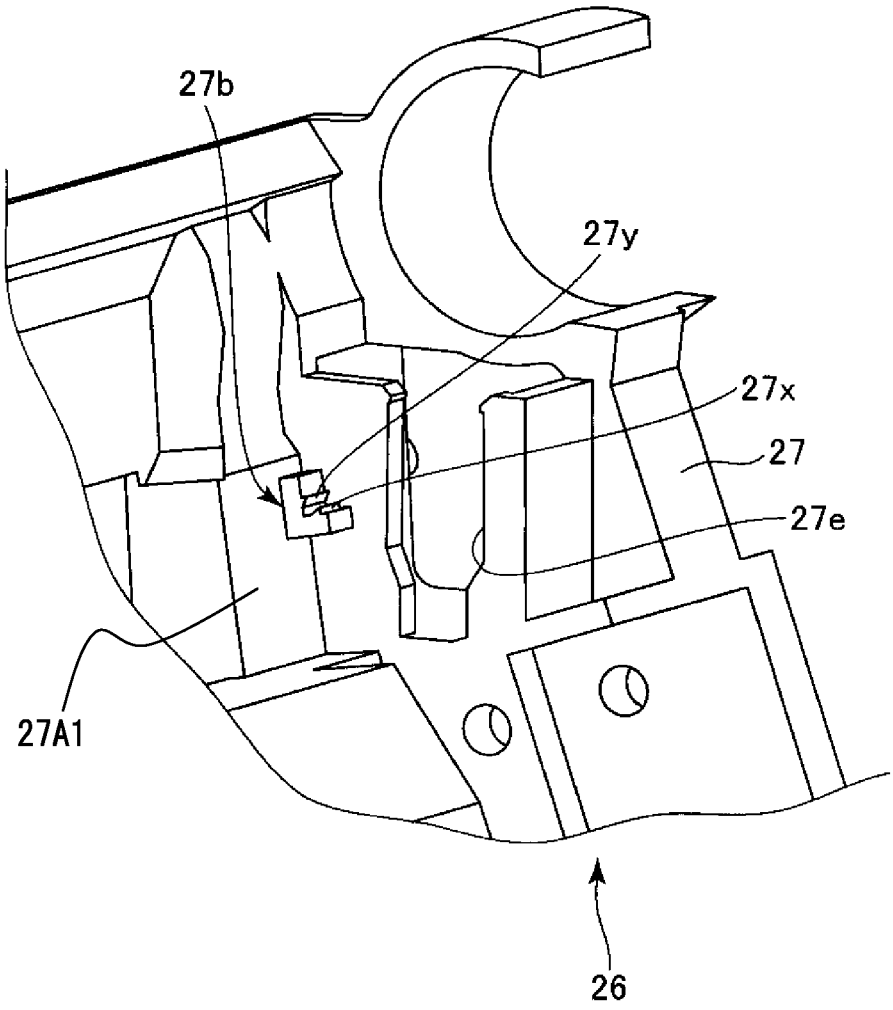
FIG. 14 is a partial perspective view of the cleaning frame according to the embodiment of the present invention, for illustrating another configuration example of a support portion.
Figure 15:
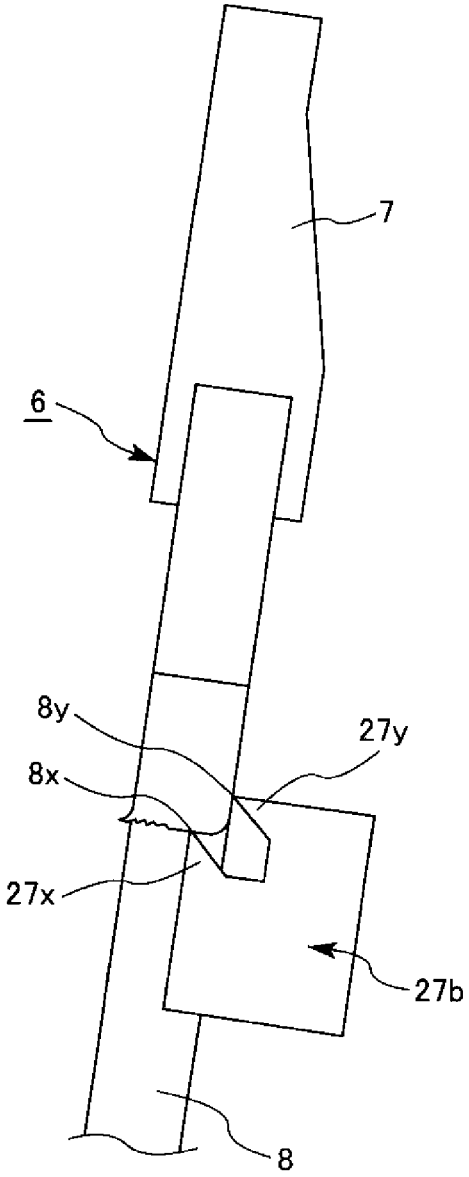
FIG. 15 is a partial sectional view of the cleaning unit according to the embodiment of the present invention, for illustrating the configuration example of the support portion.

For example, with another shape as illustrated in FIGS. 14 and 15, the same advantages as those in the embodiment can be obtained. FIG. 14 is a partial perspective view of the inner surface 27A1 of the cleaning frame 27 (specifically, cleaning frame main body 27A). FIG. 15 is a still another partial sectional view of a substantial part of the cleaning member 6 and the cleaning frame 27, for illustrating how the abutment portion 8*a* of the cleaning member 6 and the support portion 27*b* of the cleaning frame 27 are in abutment with each other. As illustrated in FIGS. 15 and 16, the first support portion 27*y* and the second support portion 27*x* as viewed in the direction of the rotation axis of the photosensitive drum 1 each may be formed into a protruding shape having an apex in cross-section. Also in this case, as described above in the embodiment, the first support portion 27*y* and the second support portion 27*x* are in contact with the first abutment portion 8*y* and the second abutment portion 8*x*, respectively, at the spaces along straight lines extending in the direction of the rotation axis of the photosensitive drum 1.

Figure 16A:
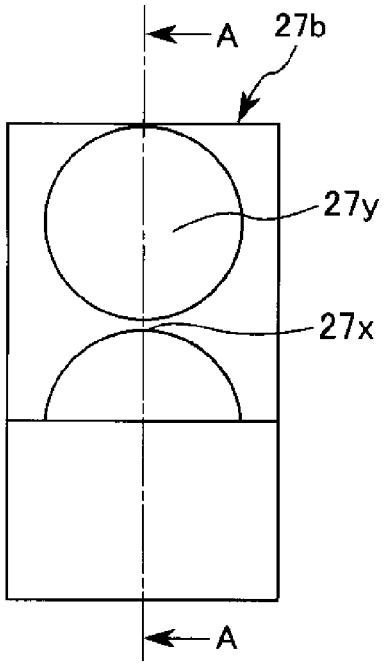
FIGS. 16A and 16B are a front view and a sectional view, respectively, for illustrating still another configuration example of the support portion according to the embodiment of the present invention.
Figure 16B:
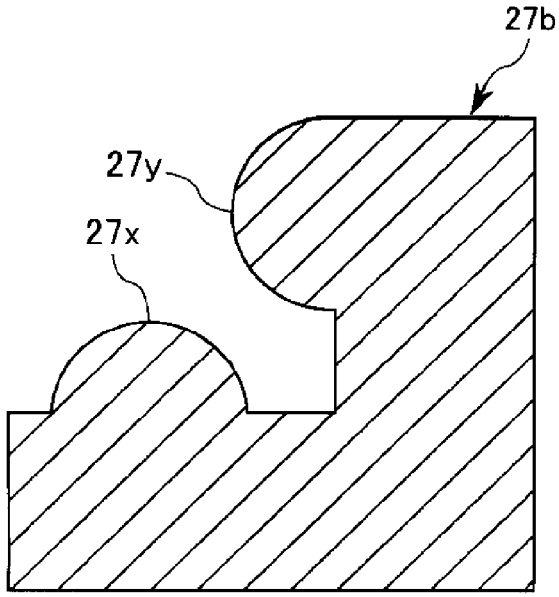

Alternatively, as still another example, as illustrated in FIGS. 16A and 16B, the first support portion 27*y* and the second support portion 27*x* may be in point contact with the first abutment portion 8*y* and the second abutment portion 8*x*, respectively. FIG. 16A is a front view in which the support portion 27*b* of the cleaning frame 27 is viewed from the cleaning member 6, and FIG. 16B is a sectional view of the support portion 27*b* of the cleaning frame 27. In the example illustrated in FIGS. 16A and 16B, two dome-shaped apices formed on the support portion 27*b* of the cleaning frame 27 serve as the first support portion 27*y* and the second support portion 27*x*, respectively. As a matter of course, the shape of the support portion 27*b* is not limited to the above-mentioned circular-arc shape or the protruding shape having the apex. Even in a case of using the first support portion 27*y* and the second support portion 27*x* of the support portion 27*b*, which each have such a shape of the still another example, the same advantages as those in the case of using the first support portion 27*y* and the second support portion 27*x* of the support portion 27*b*, each having the circular-arc shape described above in the embodiment, can be obtained.

Second Embodiment

Next, another embodiment of the present invention will be described. The basic structures of a cleaning unit, a process cartridge, and an image forming apparatus according to the embodiment are the same as those of the first embodiment. Therefore, in the embodiment, components having the same functions and structures as those of the first embodiment or having the functions and structures corresponding thereto are denoted by the same reference symbols, and detailed description thereof is omitted.

In the following, only the one end portion (front end portion) in the longitudinal direction of the process cartridge 70 (substantially parallel to the direction of the rotation axis of the photosensitive drum 1) will be described in detail. Meanwhile, the other end portion (rear end portion), which has substantially the same (substantially symmetrical) structure, is not described unless it is necessary to make specific description.

In the embodiment, even when the abutment portion 8*a* of the cleaning member 6 is displaced with respect to the support portion 27*b* of the cleaning frame 27 during transportation, the cleaning member 6 is returned to the original position by an urging force of an urging member. In this way, a position of the cleaning member 6 is stabilized. Further, in the embodiment, displacement in the longitudinal direction of the cleaning member 6 with respect to the cleaning frame 27 is suppressed.

Figure 17:
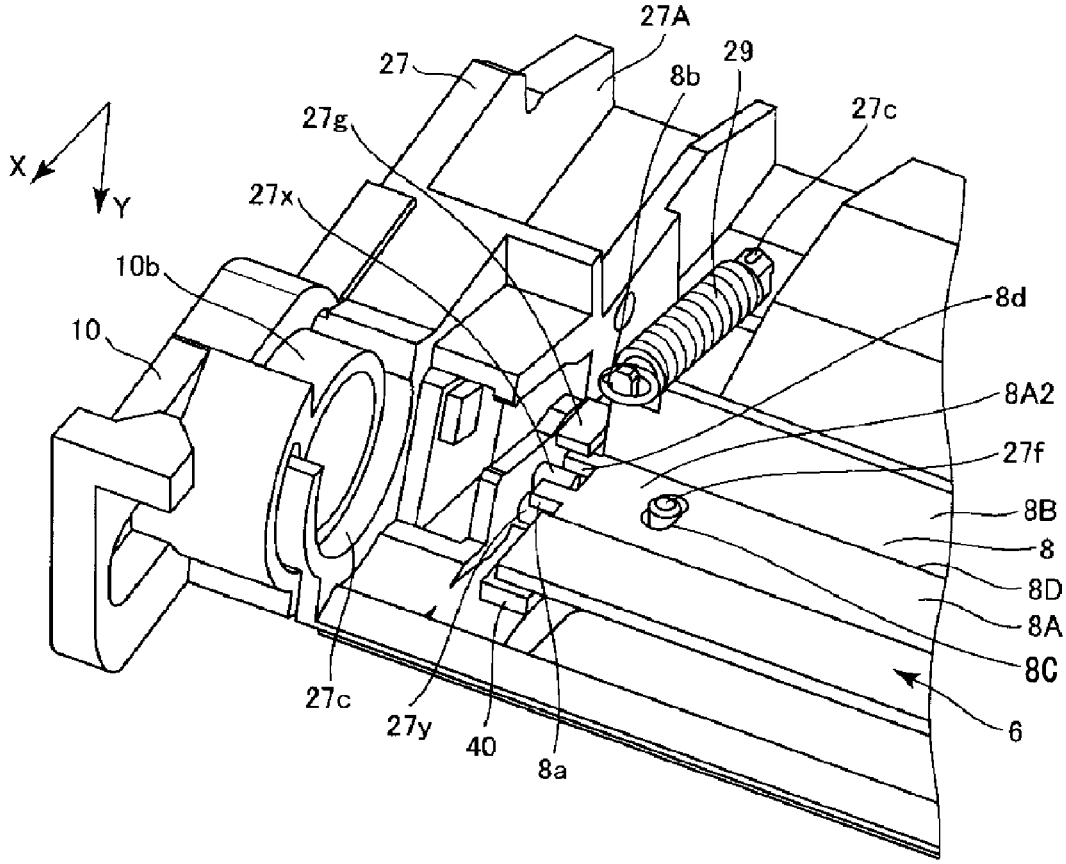
FIG. 17 is a partially exploded perspective view of a cleaning unit according to another embodiment of the present invention.

First, how to position the cleaning member 6 according to the embodiment in the longitudinal direction will be described. FIG. 17 is a perspective view of the cleaning unit 26 as viewed from the drum front bearing 10 side in a state in which the photosensitive drum 1, the charging roller 2, and so on are removed.

As illustrated in FIG. 17, in the embodiment, the cleaning member 6 is provided with a positioning hole 8C configured to position the cleaning member 6 in the longitudinal direction with respect to the cleaning frame 27. In the embodiment, the positioning hole 8C is an elongate hole formed near the end portion in the longitudinal direction of the main part 8A of the support member 8 and extending in the direction substantially orthogonal to the longitudinal direction of the main part 8A of the support member 8. The positioning hole 8C is engaged with a positioning boss 27*f* provided on the cleaning frame 27. With this, the cleaning member 6 can be positioned in the longitudinal direction with respect to the cleaning frame 27 in a state in which the cleaning member 6 is pivotable about the abutment portion 8*a* as a pivot axis. In the embodiment, the positioning boss 27*f* is a substantially columnar protrusion provided upright with respect to the inner surface 27A1 of the cleaning frame 27.

In the embodiment, the positioning hole 8C and the positioning boss 27*f* are disposed only on the one end (front end portion) in the longitudinal direction of the cleaning unit 26. However, the positioning hole 8C and the positioning boss 27*f* need not be disposed on the one end (front end portion), and may be disposed only on the other end (rear end portion).

Next, a state of the abutment portion 8*a* of the cleaning member 6 and the support portion 27*b* of the cleaning frame 27 at the time when the process cartridge 70 drops, for example, in a direction (direction indicated by an arrow D in FIG. 3) perpendicular to the direction of the rotation axis of the photosensitive drum 1 will be described.

Figure 18:
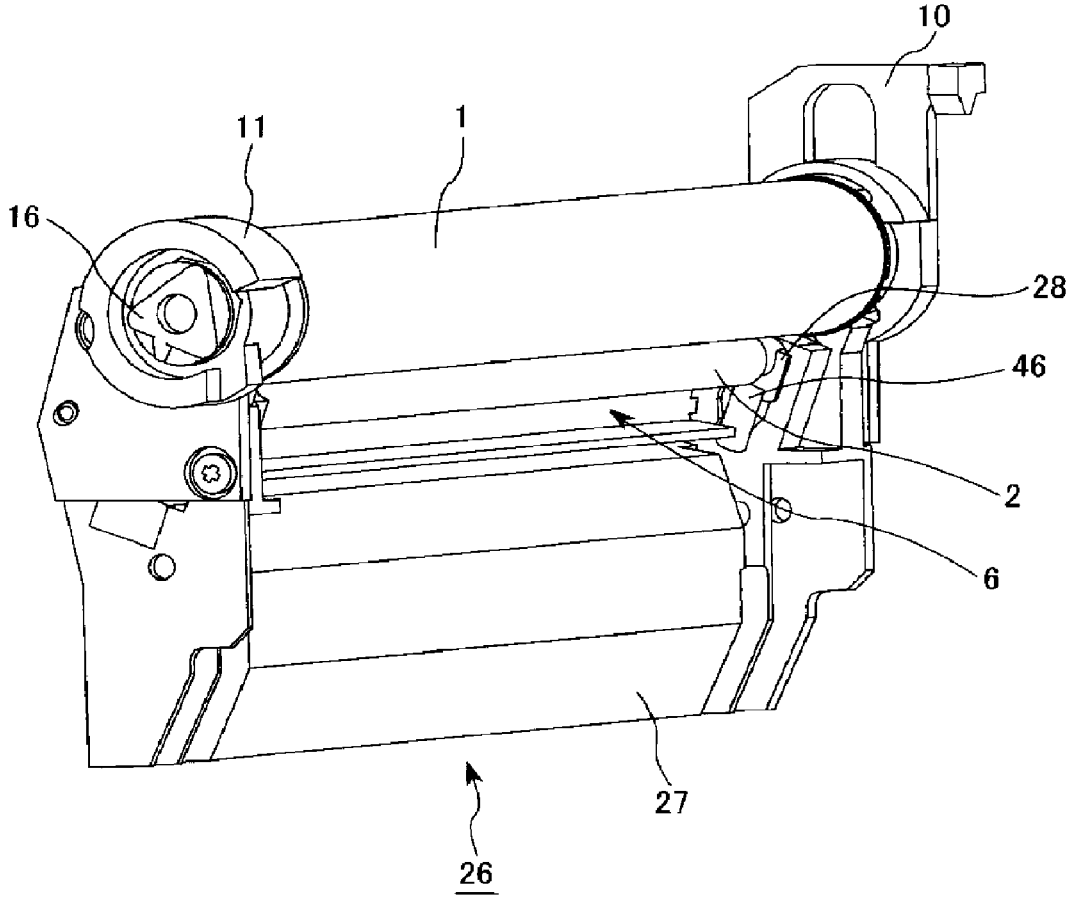
FIG. 18 is a perspective view of the cleaning unit according to another embodiment of the present invention.
Figure 19:
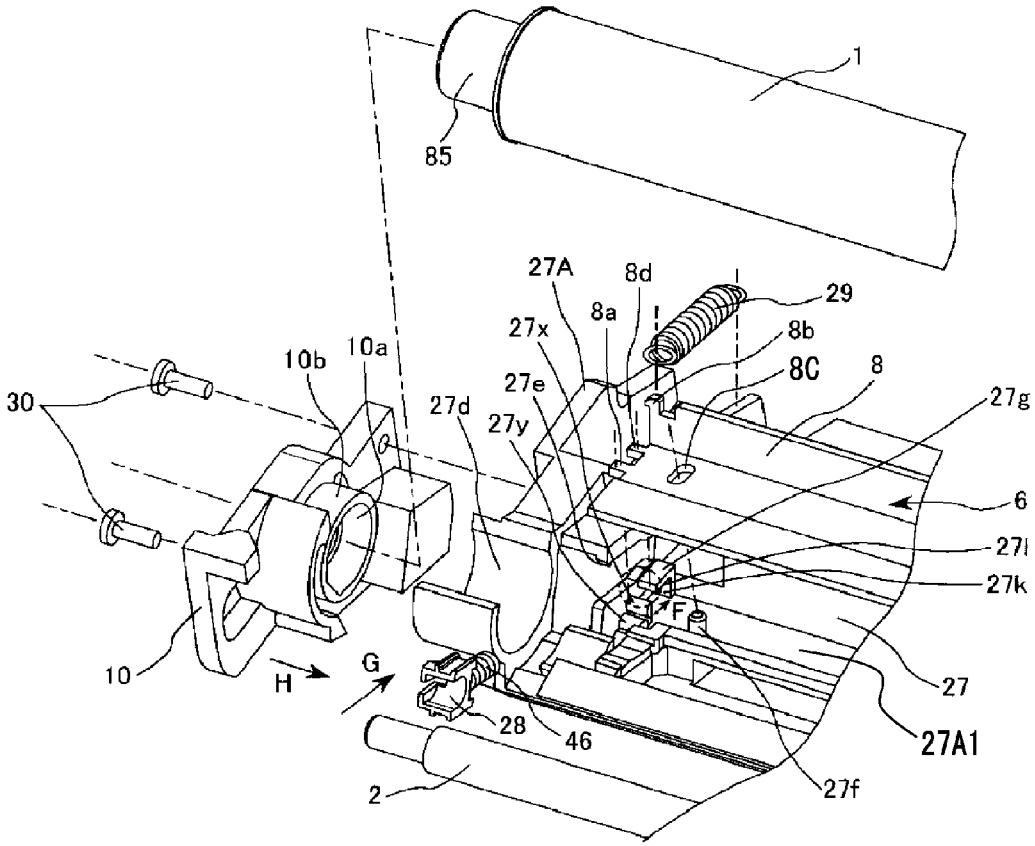
FIG. 19 is an exploded perspective view of the cleaning unit according to another embodiment of the present invention.
Figure 20:
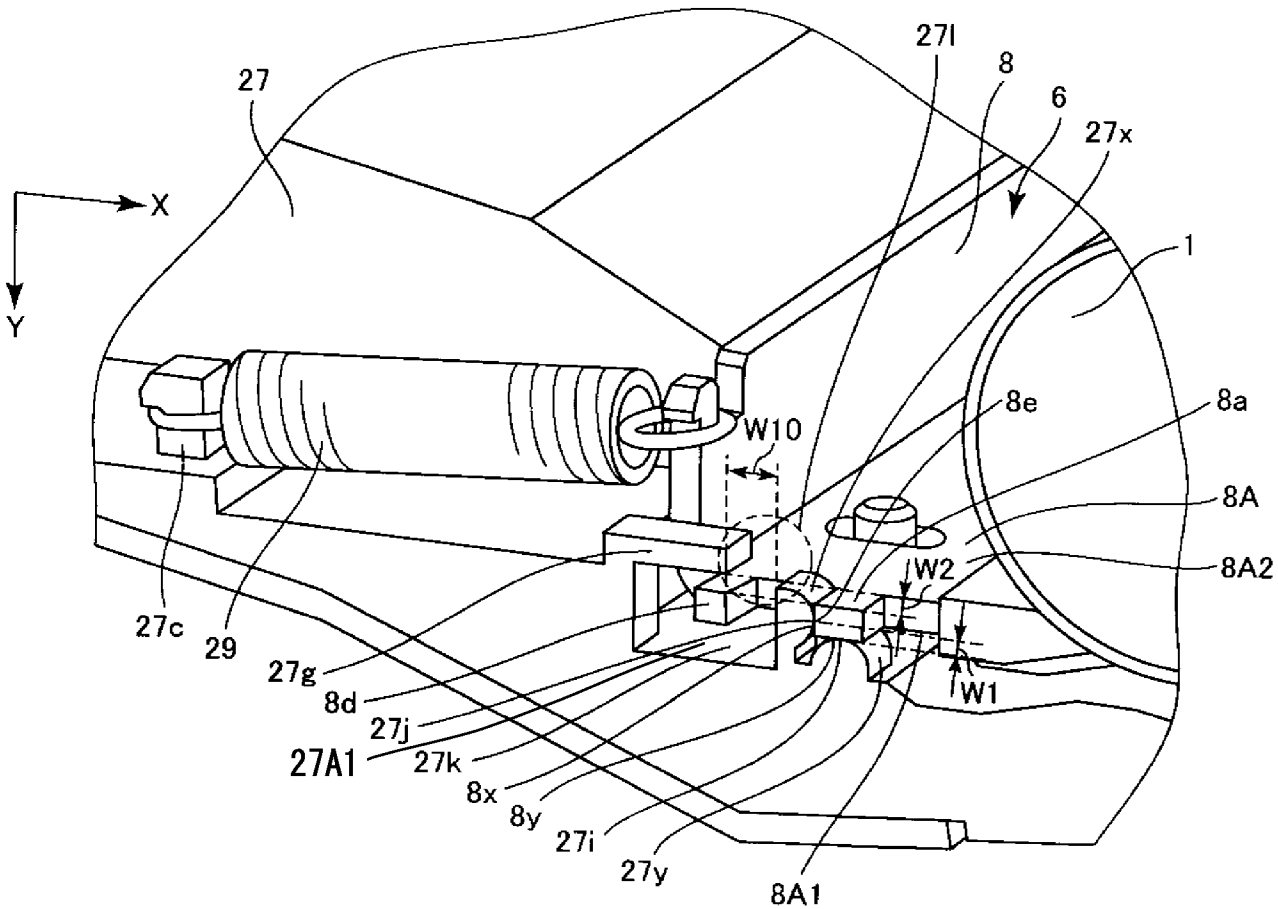
FIG. 20 is a partial sectional view of the cleaning unit according to another embodiment of the present invention.
Figure 21:
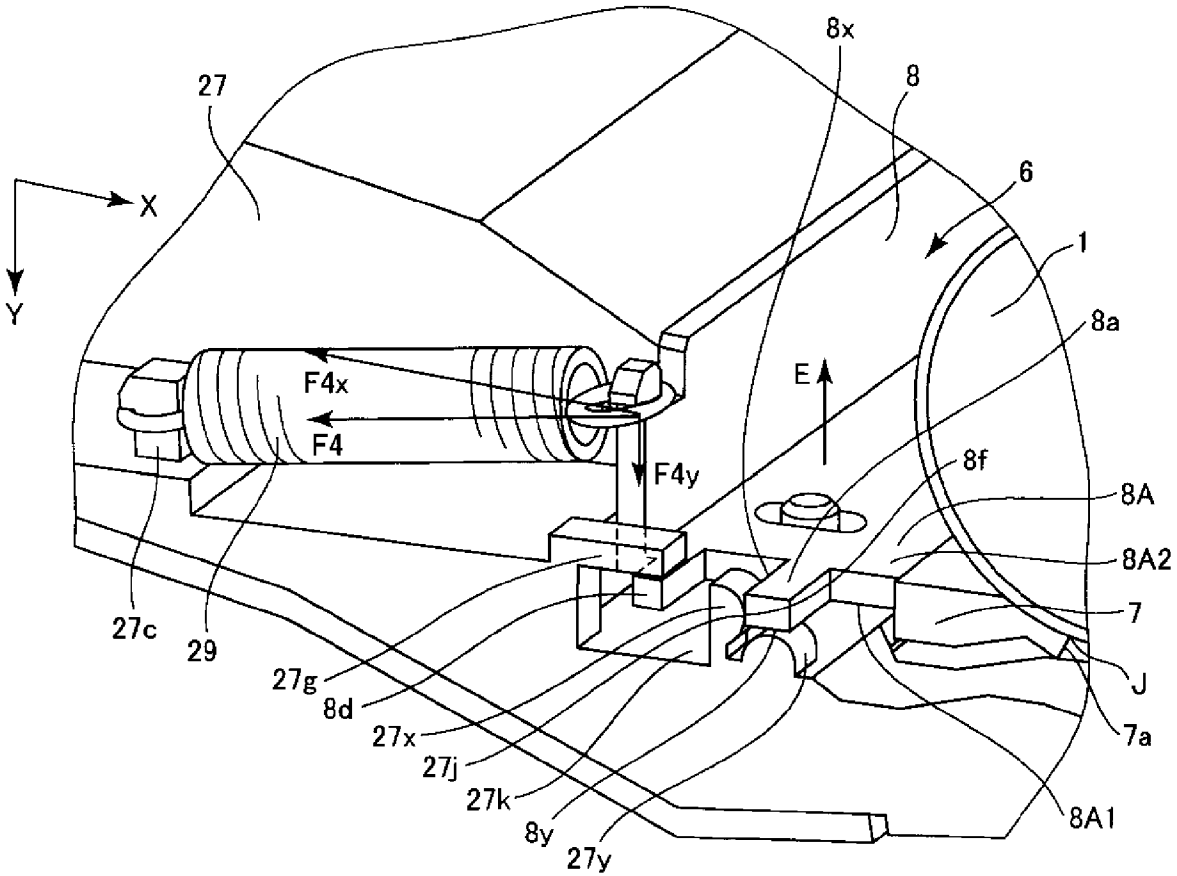
FIG. 21 is a partial sectional view of the cleaning unit according to another embodiment of the present invention.

FIG. 18 is a perspective view of the cleaning unit 26 from which the developing unit 4 is removed. FIG. 19 is an exploded perspective view of the cleaning unit 26 as viewed from the drum front bearing 10. FIG. 20 is a partial sectional view illustrating a positional relationship between the cleaning member 6 and the cleaning frame 27 in the state in which the process cartridge 70 is maintained in a stationary state and rotation of the photosensitive drum 1 is stopped. Further, FIG. 21 is a partial sectional view illustrating a positional relationship between the cleaning member 6 and the cleaning frame 27 at the time of, for example, drop of the process cartridge 70.

As illustrated in FIG. 17, at the one end portion in the longitudinal direction of the main part 8A of the support member 8 for the cleaning member 6, a projecting portion (projection shape) 8*d* as a regulated portion disposed opposite to a regulating portion 27*g* described below is projected. In the embodiment, the projecting portion 8*d* is formed into a substantially rectangular parallelepiped shape of which one side surface is continuous with the side surface of the end portion in the longitudinal direction of the main part 8A of the support member 8. One side surface among side surfaces of the projecting portion 8*d*, which is flush with the second side surface 8A2 of the main part 8A of the support member 8, is opposite to and comes into contact with the regulating portion 27*g* described below. Further, in the embodiment, the projecting portion 8*d* is provided adjacent to the bent part 8D of the main part 8A of the support member 8.

Meanwhile, at the one end portion in the longitudinal direction of the cleaning frame 27 (specifically, in the embodiment, cleaning frame main body 27A), the regulating portion 27*g* is provided in a position opposite to the projecting portion 8*d* of the cleaning member 6 at a predetermined clearance (in the −Y direction with respect to the projecting portion 8*d*). In other words, in the embodiment, the regulating portion 27*g* is provided on the cleaning frame 27 (specifically, cleaning frame main body 27A) so as to be opposite to the projecting portion 8*d* of the cleaning member 6 from the side of the photosensitive drum 1 with the predetermined clearance between the regulating portion 27*g* and the projecting portion 8*d*.

When the process cartridge 70 is subject to an impact due to a falling of the process cartridge 70, the regulating portion 27*g* regulates the first abutment portion 8*y* and the second abutment portion 8*x* from being displaced with respect to the first support portion 27*y* and the second support portion 27*x* (in the −Y direction), respectively, to thereby regulate the abutment portion 8*a* from being disengaged from the support portion 27*b*. Then, with the urging force of the tension spring 29, the position of the first abutment portion 8*y* with respect to the first support portion 27*y* and the position of the second abutment portion 8*x* with respect to the second support portion 27*x* are returned to the original positions at which the process cartridge 70 is maintained in a stationary state and rotation of the photosensitive drum 1 is stopped. This mechanism will be described in detail below.

Note that, in the embodiment, in the lateral direction of the main part 8A of the support member 8, the abutment portion 8*a* is disposed on the support member 8 on the side of the rubber blade 7, and the projecting portion 8*d* is disposed on the support member 8 on the side of the bent part 8D. However, in the arrangement in the lateral direction of the main part 8A of the support member 8, the abutment portion 8*a* and the projecting portion 8*d* may be changed round.

FIG. 20 illustrates a state in which the process cartridge 70 is maintained in a stationary state and rotation of the photosensitive drum 1 is stopped. The apex (a contact position between the first abutment portion 8*y* and the first support portion 27*y*) of the outer peripheral surface of the circular-arc shape in cross-section of the first support portion 27*y* in this state is defined as a first apex 27*i*. Further, the apex (a contact position between the second abutment portion 8*x* and the second support portion 27*x*) of the outer peripheral surface of the circular-arc shape in cross-section of the second support portion 27*x* in the same state is defined as a second apex 27*j*. In addition, the first apex 27*i* and the second apex 27*j* are separated from each other by a distance W1 in a direction in which the first abutment portion 8*y* is moved away from the first support portion 27*y* (substantially in the −Y direction). Similarly, in this state, the projecting portion 8*d* and the regulating portion 27*g* opposing to the projecting portion 8*d* are separated from each other (substantially in the −Y direction) by a distance W2. In other words, the regulating portion 27*g* is arranged at a position spaced apart from the projecting portion 8*d* by the distance W2 (>0). With this, without hindering a pivot of the cleaning member 6 about the abutment portion 8*a* as a pivot axis, movement of the projecting portion 8*d* can be regulated with the regulating portion 27*g*. The distance W1 and the distance W2 have a relationship of W1≥W2. This setting will be described in detail below.

As illustrated in FIG. 21, when a drop impact or the like is exerted on the process cartridge 70, the following may occur. Specifically, the cleaning member 6 may be rotated about a fulcrum or a contact position J between the tip portion 7*a* of the rubber blade 7 and the photosensitive drum 1 in a direction (a direction indicated by an arrow E in FIG. 21) in which the first abutment portion 8*y* of the support member 8 is moved away from the first support portion 27*y* of the cleaning frame 27.

At this time, the projecting portion 8*d* of the support member 8 comes into contact with the regulating portion 27*g* of the cleaning frame 27 so as to regulate the rotation in the above-mentioned direction. A contact position of the second abutment portion 8*x* with the second support portion 27*x* at this time is defined as a displacement contact position 8*f*. Further, a contact position of the second abutment portion 8*x* with the second support portion 27*x* in the state in which the process cartridge 70 is maintained in a stationary state and rotation of the photosensitive drum 1 is stopped is defined as a stationary contact position 8*e* (FIG. 20). In this case, the displacement contact position 8*f* substantially corresponds to a position moved in the Y direction from the stationary contact position 8*e* by the distance W2. As described above, the relationship of W1≥W2 is established (FIG. 20). In other words, the moving distance W2 at the time of application of the above-mentioned impact and the maximum moving distance W1 which allows the second abutment portion 8*x* in contact with the second support portion 27*x* have a relationship of W1=W2 or W1>W2.

Thus, the abutment portion 8*a* of the support member 8 is not disengaged from the second support portion 27*x*. Further, the regulating portion 27*g* is positioned in the distance relationships as described above, and hence, after the movement by the distance W2, an urging force F4*y* in the Y direction of the tension spring 29 causes the abutment portion 8*a* of the support member 8 to return to the original position at which the process cartridge 70 is maintained in a stationary state and rotation of the photosensitive drum 1 is stopped. In this way, the above-mentioned distance relationship of W1≥W2 is satisfied, and hence the position of the cleaning member 6 is stabilized even when the drop impact or the like of the process cartridge 70 is applied.

In this way, the cleaning frame 27 has the regulating portion 27*g* configured to regulate the abutment portion 8*a* from being moved in the direction in which the first abutment portion 8*y* is moved away from the first support portion 27*y*. The regulating portion 27*g* opposes to the projecting portion 8*d* of the cleaning member 6 from the side of the photosensitive drum 1 with the predetermined clearance between the regulating portion 27*g* and the projecting portion 8*d* while allowing the cleaning member 6 to pivot about the abutment portion 8*a* as a pivot axis. More specifically, a distance in the separation direction from the contact position between the first abutment portion 8*y* and the first support portion 27*y* to the contact position between the second abutment portion 8*x* and the second support portion 27*x* is equal to or longer than the predetermined clearance. It is desired that the regulating portion 27*g* include regulating portions 27*g* provided at at least two points in the direction along the direction of the rotation axis of the photosensitive drum 1. With this, the position of the cleaning member 6 can be further stabilized during transportation or the like. In the embodiment, the regulating portion 27*g* is provided to each of both the end portions of the cleaning member 6 in the direction along the direction of the rotation axis of the photosensitive drum 1. Note that, when desired, the regulating portion 27*g* may be provided only one point in the direction along the direction of the rotation axis of the photosensitive drum 1, such as one of both the end portions of the cleaning member 6 in the direction along the direction of the rotation axis of the photosensitive drum 1.

Next, a procedure for assembling the cleaning unit 26 according to the embodiment will be described.

As illustrated in FIG. 19, first, the projecting portion 8*d* is temporarily set to a temporal receiving portion 27*k* in a manner that the projecting portion 8*d* of the support member 8 is inserted through an opening portion 27*l* of the temporal receiving portion 27*k* of the cleaning frame 27 (direction indicated by an arrow F in FIG. 19). The temporal receiving portion 27*k* is formed on the inner surface 27A1 of the cleaning frame 27 so as to be opposed to the regulating portion 27*g*, and the opening portion 27*l* is formed of a clearance between the support portion 27*b* and a distal end of the regulating portion 27*g* on the side of the support portion 27*b* (FIG. 20). A dimension of a distance W10 (X direction) between the distal end of the regulating portion 27*g* and the support portion 27*b* in the opening portion 27*l* of the temporal receiving portion 27*k* is set to be larger than a dimension in the X direction of the projecting portion 8*d* so as to allow the projecting portion 8*d* to pass through the opening portion 27*l*.

Then, the abutment portion 8*a* of the support member 8 is brought into abutment with the support portion 27*b* of the cleaning frame 27. Simultaneously, the first abutment portion 8*y* and the second abutment portion 8*x* of the support member 8 come into contact with the first support portion 27*y* and the second support portion 27*x* of the cleaning frame 27, respectively. In this way, the support member 8 is roughly positioned with respect to the cleaning frame 27. Further, at this time, as illustrated in FIG. 17, the positioning hole 8C of the cleaning member 6 and the positioning boss 27*f* of the cleaning frame 27 are engaged with each other. As described above, the positioning hole 8C is an elongate hole elongated in the lateral direction (X direction) of the main part 8A of the support member 8, and clearances are formed between rim portions in the X direction of the positioning hole 8C and the positioning boss 27*f*. Meanwhile, in the longitudinal direction of the cleaning member 6, the positioning hole 8C and the positioning boss 27*f* are configured to have a fitting relationship. With this, without hindering a pivot of the cleaning member 6 about the abutment portion 8*a* as a pivot axis, the cleaning member 6 can be positioned in the longitudinal direction with respect to the cleaning frame 27.

Next, as illustrated in FIG. 19, the charging roller bearing 28 and the charging roller pressure member 46 are mounted to the receiving portion 27*e* of the cleaning frame 27 in a direction indicated by an arrow G in FIG. 19. Then, the charging roller 2 is mounted to the charging roller bearing 28 in the direction indicated by the arrow G in FIG. 19. In this way, the charging roller 2 is attached to the cleaning frame 27.

Next, as illustrated in FIG. 19, the flange 85 of the photosensitive drum 1 is temporarily set to the drum positioning portion 27*d* provided to the cleaning frame 27. The drum positioning portion 27*d* has the inner diameter dimension larger than the outer diameter dimension of the flange 85 of the photosensitive drum 1. Thus, the photosensitive drum 1 can be temporarily positioned to the cleaning frame 27.

Next, as indicated by an arrow H in FIG. 19, the drum front bearing 10 is mounted to the cleaning frame 27 in the direction of the rotation axis of the photosensitive drum 1. The drum front bearing 10 includes the rotary shaft support portion 10*a* for the photosensitive drum 1. With this, when the drum front bearing 10 is attached to the cleaning frame 27, the photosensitive drum 1 and the rotary shaft support portion 10*a* are positioned relative to each other. The bearing positioning portion 10*b* of the drum front bearing 10 and the drum positioning portion 27*d* of the cleaning frame 27 are each formed to have dimensions so as to be fitted to each other. Through engagement of those portions, the drum front bearing 10 is positioned with respect to the cleaning frame 27. Further, the drum front bearing 10 and the cleaning frame 27 respectively include positioning units (not shown) configured to position the drum front bearing 10 and the cleaning frame relative to each other in the sectional direction (rotational direction) substantially orthogonal to the direction of the rotation axis of the photosensitive drum 1. Through engagement of those units, the drum front bearing and the cleaning frame 27 are positioned relative to each other in the sectional direction.

In this state, the drum front bearing 10 and the cleaning frame 27 are fixed to each other with the fixing units such as the screws 30. With this, the assembly of the drum front bearing 10 to the cleaning frame 27 is completed.

Lastly, as illustrated in FIG. 19, the tension spring 29 is stretched between the attaching portion 8*b* of the cleaning member 6 and the boss 27*c* of the cleaning frame 27.

The procedure for assembling the cleaning unit 26 will be described with a focus only on the one end portion (front end portion) in the longitudinal direction of the cleaning unit 26. However, the same procedure as above is synchronously performed also on the other end portion (rear end portion) of the cleaning unit 26. Note that, at the other end portion (rear end portion) of the cleaning unit 26, the drum rear bearing 11 is attached to the cleaning frame 27 by the same method as above. Further, in the embodiment, as described above, at the other end portion (rear end portion) of the cleaning unit 26, the positioning hole 8C of the cleaning member 6 and the positioning boss 27*f* of the cleaning frame 27 are not provided.

With this, assembly of the cleaning unit 26 is completed, and the cleaning member 6 abuts against the photosensitive drum 1 by a predetermined pressure. In this way, preparation of cleaning is completed.

As described above, according to the embodiment, even when the abutment portion 8*a* of the cleaning member 6 is displaced with respect to the support portion 27*b* of the cleaning frame 27 during transportation or the like, the cleaning member 6 is regulated by the regulating portion 27*g*, and returned to the original position by the urging force of the tension spring 29. In this way, the position of the cleaning member 6 is stabilized.

Third Embodiment

Next, still another embodiment of the present invention will be described. The basic structures of a cleaning unit, a process cartridge, and an image forming apparatus according to the embodiment are the same as those of the second embodiment. Therefore, in the embodiment, components having the same functions and configurations as those of the second embodiment or having the functions and configurations corresponding thereto are denoted by the same reference symbols, and detailed description thereof is omitted.

In the embodiment, as in the second embodiment, another example of the configuration of stabilizing the position of the cleaning member 6 during transportation or the like will be described.

Figure 22:
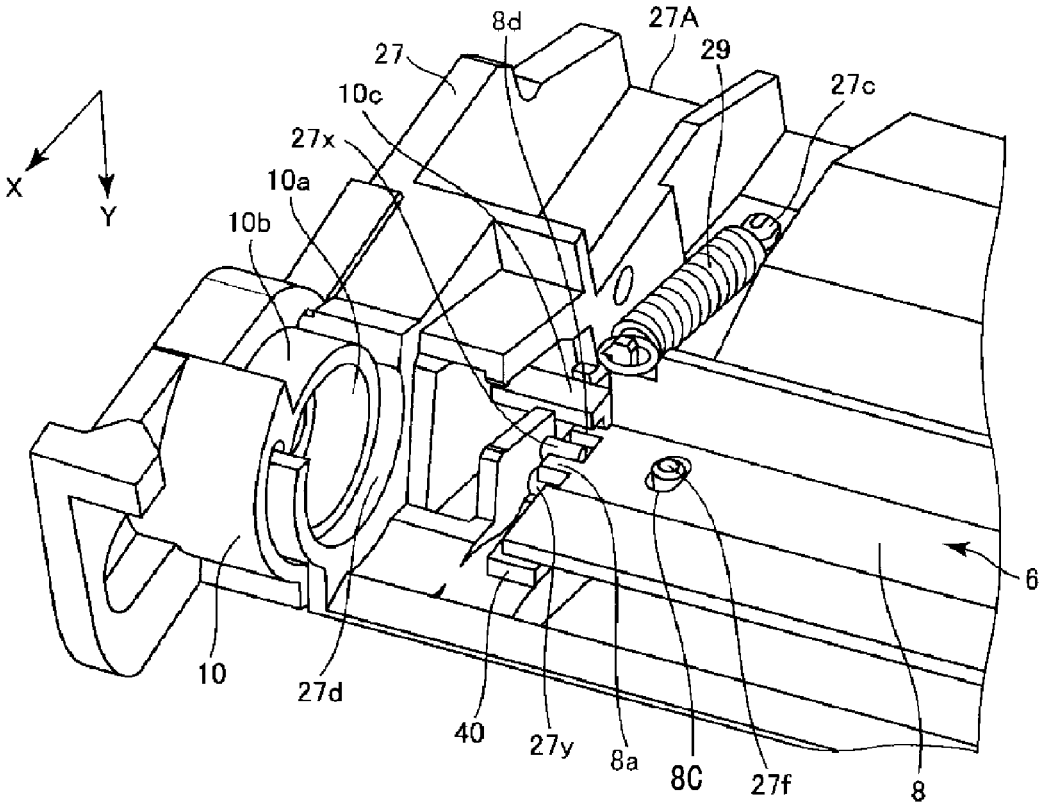
FIG. 22 is a partially exploded perspective view of a cleaning unit according to still another embodiment of the present invention.
Figure 23:
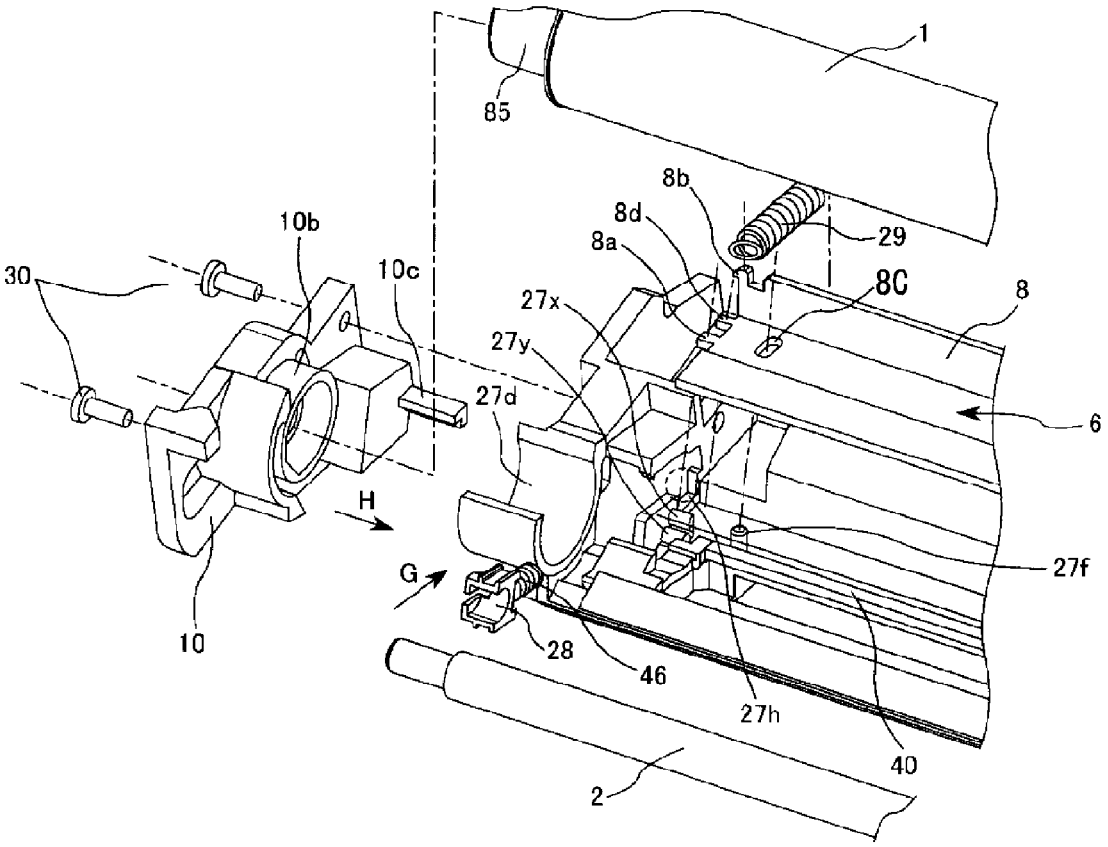
FIG. 23 is an exploded perspective view of the cleaning unit according to the still another embodiment of the present invention.
Figure 24:
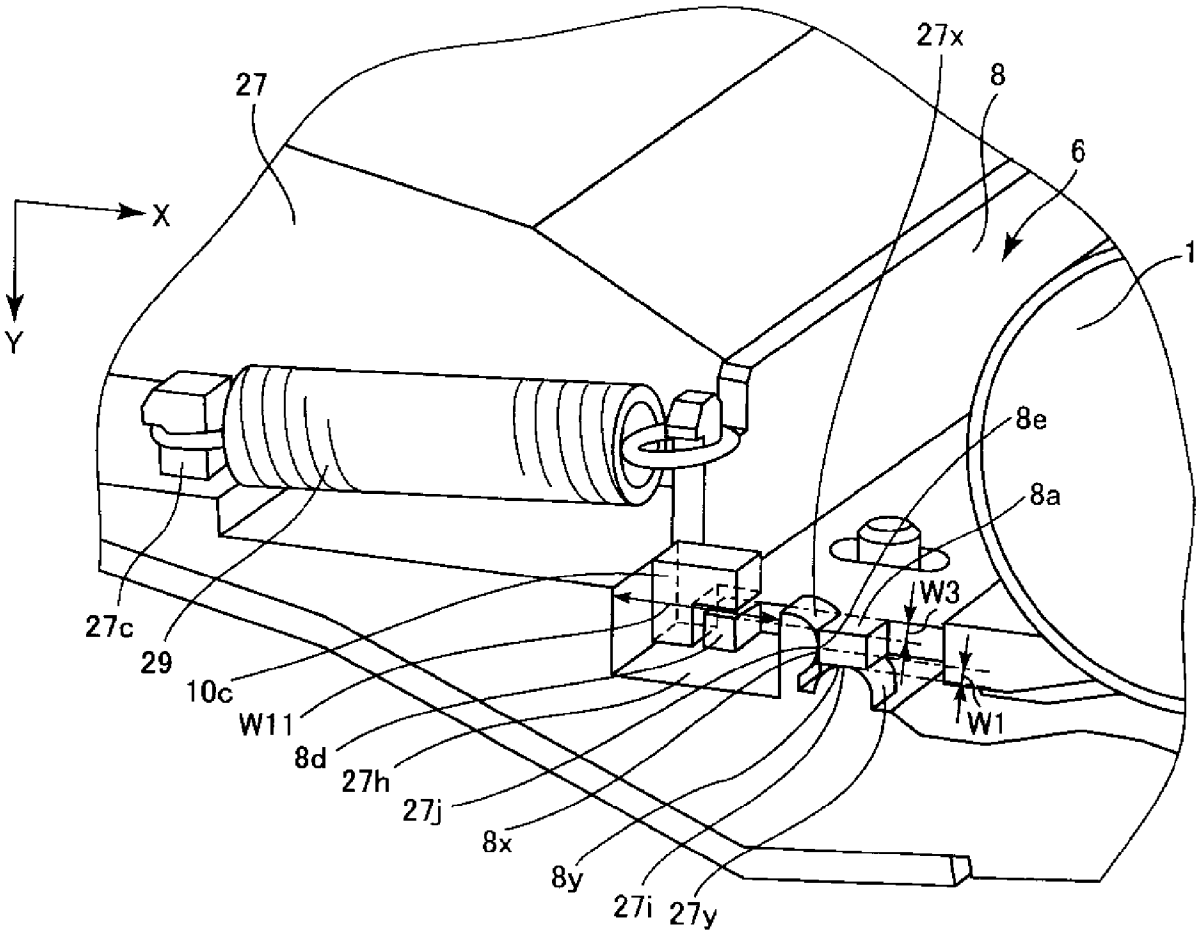
FIG. 24 is a partial sectional view of the cleaning unit according to the still another embodiment of the present invention.

FIG. 22 is an exploded perspective view of the cleaning unit 26 as viewed from the side of the drum front bearing 10, from which the photosensitive drum 1, the charging roller 2, and the like are removed. FIG. 23 is an exploded perspective view of the cleaning unit 26 as viewed from the side of the drum front bearing 10. FIG. 24 is a partial sectional view illustrating a positional relationship between the cleaning member 6 and the cleaning frame 27 in the state in which the process cartridge 70 is maintained in a stationary state and rotation of the photosensitive drum 1 is stopped. Further, FIG. 25 is another partial sectional view illustrating a positional relationship between the cleaning member 6 and the cleaning frame 27 at the time of, for example, falling of the process cartridge 70.

As illustrated in FIG. 22, in the embodiment, a regulating portion 10*c* is provided at an end portion (end portion on the side of the cleaning frame main body 27A) of the drum front bearing 10 in the direction of the rotation axis of the photosensitive drum 1. The regulating portion 10*c* is provided in a position (−Y direction with respect to the projecting portion 8*d*) which is opposed to the projecting portion 8*d* of the cleaning member 6 with a predetermined clearance between the regulating portion 10*c* and the projecting portion 8*d*. In other words, in the embodiment, the regulating portion 10*c* is provided on the drum front bearing 10 forming the cleaning frame 27 cooperatively with the cleaning frame main body 27A so as to be opposed to the projecting portion 8*d* of the cleaning member 6 from the side of the photosensitive drum 1 with the predetermined clearance between the regulating portion 10*c* and the projecting portion 8*d*.

As illustrated in FIG. 24, as in the second embodiment, the first apex 27*i* and the second apex 27*j* are separated from each other by the distance W1 in the direction (substantially in −Y direction) in which the first abutment portion 8*y* is moved away from the first support portion 27*y*. Further, a distance W3 is secured between the projecting portion 8*d* and the regulating portion 10*c* opposed to the projecting portion 8*d* (substantially in the −Y direction) in the state in which the process cartridge 70 is maintained in a stationary state and rotation of the photosensitive drum 1 is stopped. In other words, the regulating portion 10*c* is disposed in a position spaced apart from the projecting portion 8*d* by the distance W3 (>0). With this, without hindering a pivot of the cleaning member 6 about the abutment portion 8*a* as a pivot axis, movement of the projecting portion 8*d* can be regulated with the regulating portion 10*c*. The distance W1 and the distance W3 have a relationship of W1≥W3. This setting will be described in detail below.

Figure 25:
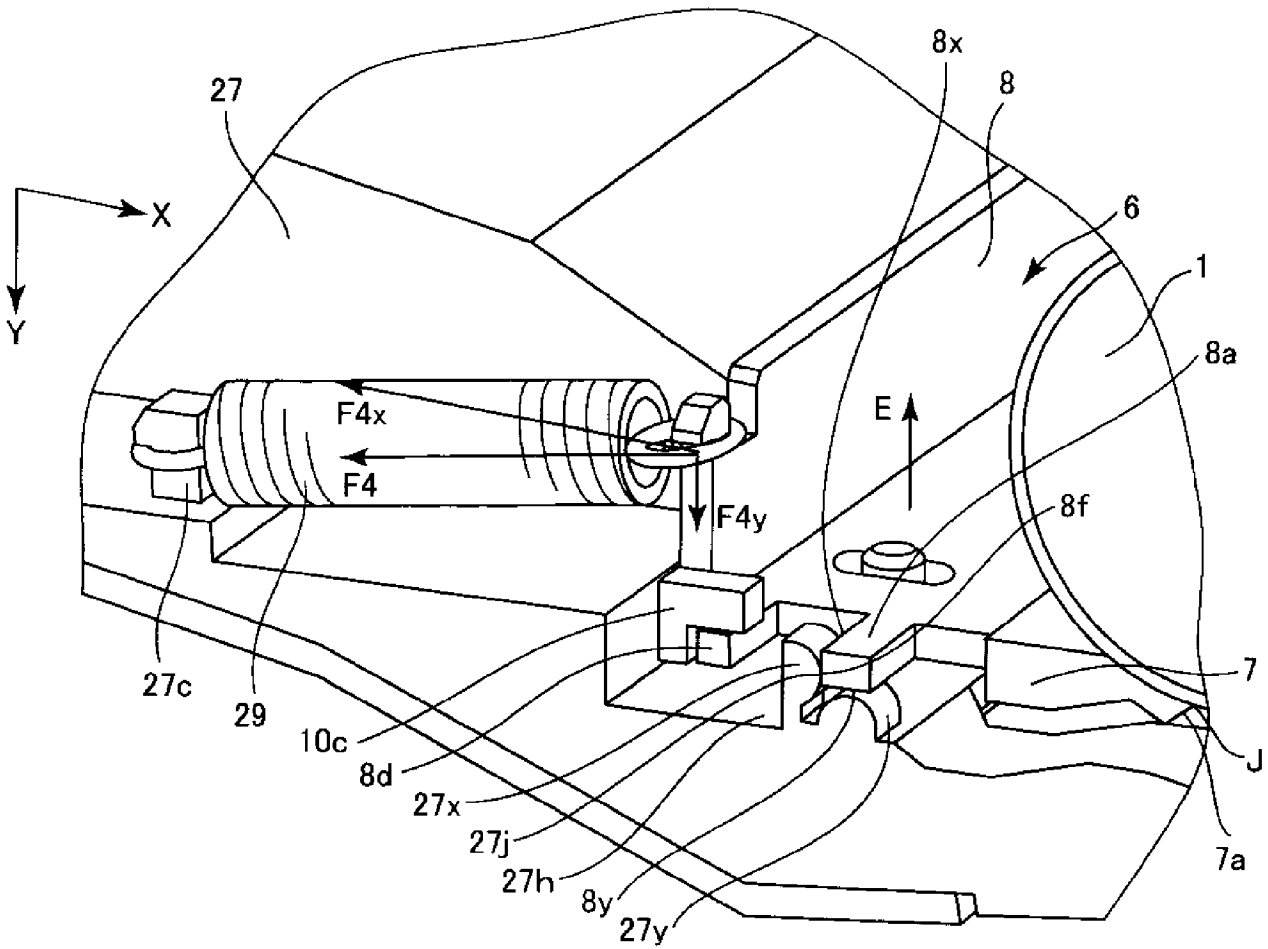
FIG. 25 is a partial sectional view of the cleaning unit according to the still another embodiment of the present invention.

As illustrated in FIG. 25, when a drop impact or the like is exerted on the process cartridge 70, the following may occur. Specifically, the cleaning member 6 may be rotated about a fulcrum or the contact position J between the tip portion 7*a* of the rubber blade 7 and the photosensitive drum 1 in the direction (direction indicated by an arrow E in FIG. 25) in which the first abutment portion 8*y* of the support member 8 is moved away from the first support portion 27*y* of the cleaning frame 27.

At this time, the projecting portion 8*d* of the support member 8 comes into contact with the regulating portion 10*c* of the drum front bearing 10 so as to regulate the rotation in the above-mentioned direction. A contact position of the second abutment portion 8*x* with the second support portion 27*x* at this time is defined as a displacement contact position 8*f*. Further, a contact position of the second abutment portion 8*x* with the second support portion 27*x* in the state in which the process cartridge 70 is maintained in a stationary state and rotation of the photosensitive drum 1 is stopped is defined as the stationary contact position 8*e* (FIG. 24). In this case, the displacement contact position 8*f* substantially corresponds to a position moved in the Y direction from the stationary contact position 8*e* by the distance W3. As described above, the relationship of W1≥W3 is established (FIG. 24). In other words, the moving distance W3 at the time when the process cartridge 70 is subject to the above-mentioned impact and the maximum moving distance W1 which allows the second abutment portion 8*x* in contact with the second support portion 27*x* have a relationship of W1=W3 or W1>W3.

Thus, the abutment portion 8*a* of the support member 8 is not disengaged from the second support portion 27*x*. Further, the regulating portion 10*c* is positioned in the distance relationships as described above, and hence, after the movement by the distance W3, the urging force F4*y* in the Y direction of the tension spring 29 causes the abutment portion 8*a* of the support member 8 to return to the original position in which the process cartridge 70 is maintained in a stationary state and rotation of the photosensitive drum 1 is stopped. In this way, the above-mentioned relationship of W1≥W3 is satisfied, and hence the position of the cleaning member 6 is stabilized even when the drop impact or the like is exerted on the process cartridge 70.

Next, a procedure for assembling the cleaning unit 26 according to the embodiment will be described.

As illustrated in FIG. 23, first, the abutment portion 8*a* of the support member 8 is brought into abutment with the support portion 27*b* of the cleaning frame 27. Simultaneously, the first abutment portion 8*y* and the second abutment portion 8*x* of the support member 8 come into contact respectively with the first support portion 27*y* and the second support portion 27*x* of the cleaning frame 27. In this way, the support member 8 is roughly positioned with respect to the cleaning frame 27.

After that, by the same procedure as that in the second embodiment, the following are performed: positioning the cleaning member 6 in the longitudinal direction thereof; assembling the charging roller 2 to the cleaning frame 27; and assembling the photosensitive drum 1 and the drum front bearing 10 to the cleaning frame 27.

When the drum front bearing 10 is fixed to the cleaning frame 27, the regulating portion 10*c* of the drum front bearing 10 is inserted into an opening portion 27*h* provided to the cleaning frame 27. As illustrated in FIG. 24, a dimension of a distance W11 (X direction) of the opening portion 27*h* is set to be larger than a dimension in the X direction of the regulating portion 10*c* so as to allow the regulating portion 10*c* of the drum front bearing 10 to be inserted.

In this state, the drum front bearing 10 and the cleaning frame 27 are fixed to each other with the fixing units such as the screws 30. With this, the assembly of the drum front bearing 10 to the cleaning frame 27 is completed.

Lastly, as illustrated in FIG. 24, the tension spring 29 is stretched between the attaching portion 8*b* of the cleaning member 6 and the boss 27*c* of the cleaning frame 27.

The procedure for assembling the cleaning unit 26 will be described with a focus only on the one end portion (front end portion) in the longitudinal direction of the cleaning unit 26. However, the same procedure is synchronously performed also on the other end portion (rear end portion) of the cleaning unit 26. Note that, at the other end portion (rear end portion)

of the cleaning unit 26, the drum rear bearing 11 is mounted to the cleaning frame 27 by the same method described above. Further, in the embodiment, as described above, at the other end portion (rear end portion) of the cleaning unit 26, the positioning hole 8C of the cleaning member 6 and the positioning boss 27*f* of the cleaning frame 27 are not provided.

With this, assembly of the cleaning unit 26 is completed, and the cleaning member 6 abuts against the photosensitive drum 1 by a predetermined pressure. In this way, preparation of cleaning is completed. Further, in this state, the regulating portion 10*c* of the drum front bearing 10 and the projecting portion 8*d* of the support member 8 are spaced apart from each other by the distance W3.

As described above, according to the embodiment, with the regulating portion 10*c* provided on the drum front bearing 10, the position of the cleaning member 6 can be stabilized during transportation or the like as in the second embodiment. In addition, assembly efficiency of can be further enhanced.

Fourth Embodiment

Next, yet another embodiment of the present invention will be described. The basic structures of a cleaning unit, a process cartridge, and an image forming apparatus according to the embodiment are the same as those of the first embodiment. Therefore, in the embodiment, components having the same functions and configurations as those of the first embodiment or having the functions and configurations corresponding thereto are denoted by the same reference symbols, and detailed description thereof is omitted.

In the embodiment, another example of the configuration of suppressing the displacement in the longitudinal direction of the cleaning member 6 will be described.

Figure 26A:
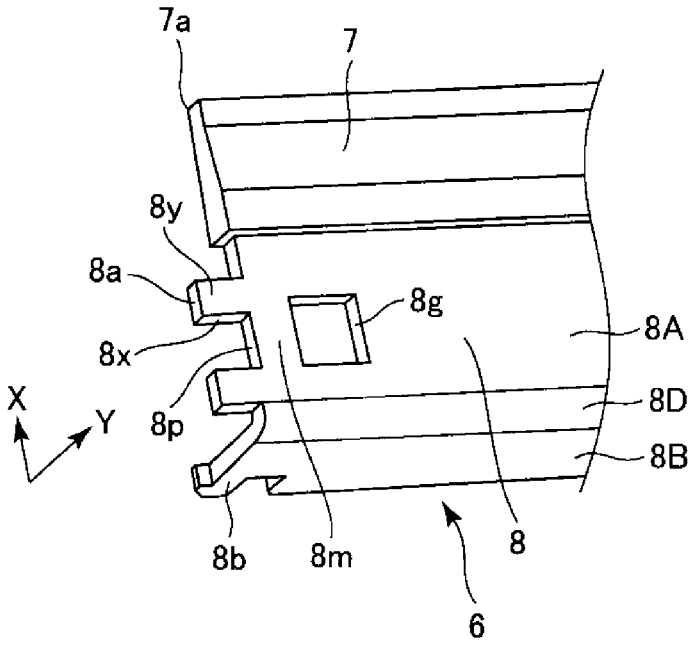
FIGS. 26A and 26B are perspective views of a cleaning unit according to yet another embodiment of the present invention.
Figure 26B:
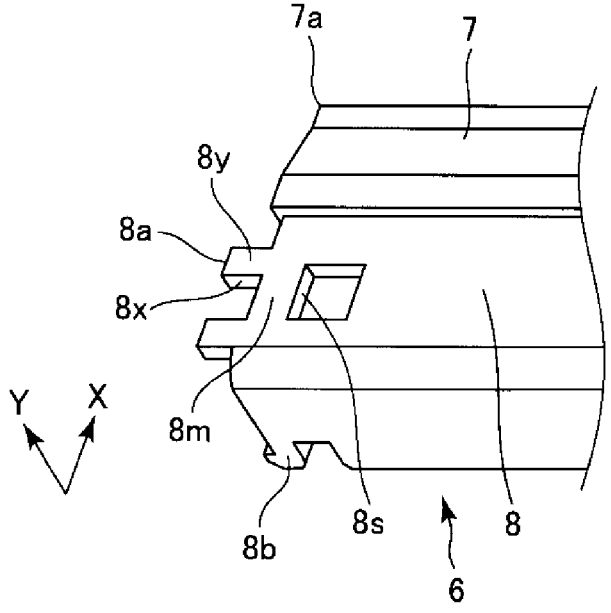

As illustrated in FIGS. 26A and 26B, in the embodiment, the cleaning member 6 is provided with a positioned portion 8*m* configured to position the cleaning member 6 in the longitudinal direction thereof with respect to the cleaning frame 27. In the embodiment, the positioned portion 8*m* is formed of a through-hole 8*g* provided near the end portion in the longitudinal direction of the main part 8A of the support member 8. In other words, the positioned portion 8*m* is a columnar portion including a side surface of the end portion in the longitudinal direction of the main part 8A of the support member 8 and an inner side surface of the through-hole 8*g*, and extending in the direction substantially orthogonal to the longitudinal direction of the main part 8A.

The positioned portion 8*m* has a first positioned surface 8*p* adjacent to the second abutment portion 8*x* of the abutment portion 8*a* and a second positioned surface 8*s* located opposite to the first positioned surface 8*p*. In the positioned portion 8*m*, the first positioned surface 8*p* is formed of the side surface of the end portion in the longitudinal direction of the main part 8A, and extends in the direction (in other word, lateral direction) substantially orthogonal to the longitudinal direction of the main part 8A. In the positioned portion 8*m*, the second positioned surface 8*s* is formed of the inner side surface of the through-hole 8*g*, and extends in the direction (in other words, lateral direction) substantially orthogonal to the longitudinal direction of the main part 8A.

Figure 27A:
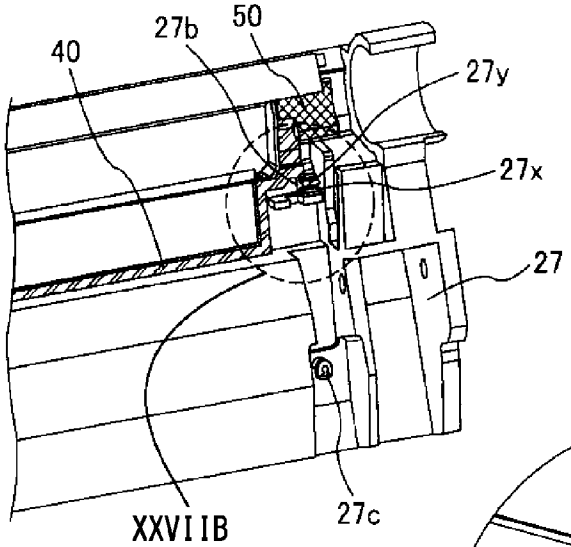
FIG. 27A is a perspective view of a cleaning frame according to the yet another embodiment of the present invention.
Figure 27B:
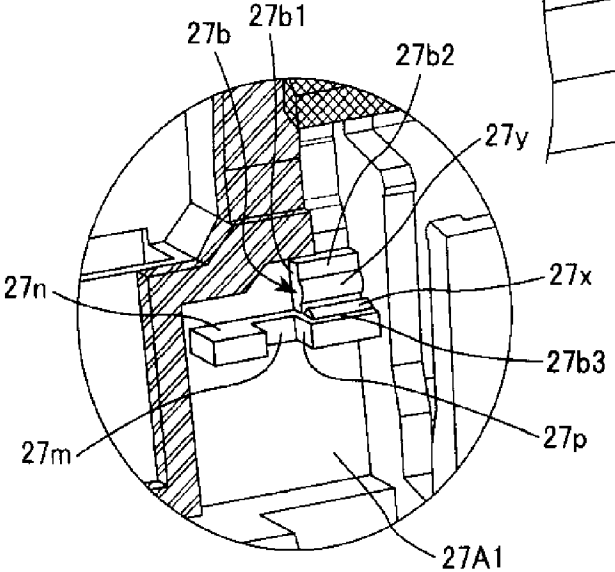
FIG. 27B is a partially enlarged perspective view of an encircled portion XXVIIB in FIG. 27A.
Figure 27C:
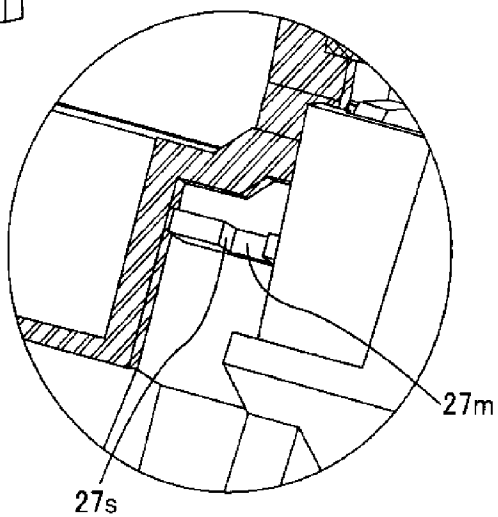
FIG. 27C is a partially enlarged perspective view of a positioning portion of FIG. 27B as viewed in another direction.

Further, in the embodiment, as illustrated in FIGS. 27A, 27B, and 27C, the cleaning frame 27 includes a positioning portion 27*m* configured to position the cleaning member 6 in the longitudinal direction thereof with respect to the cleaning frame 27. The positioning portion 27*m* has a first positioning surface 27*p* which comes into contact with the first positioned surface 8*p*, and a second positioning surface 27*s* which is opposed to the first positioning surface 27*p* and comes into contact with the second positioned surface 8*s*. The first positioning surface 27*p* and the second positioning surface 27*s* each extend in the −Y direction from the inner surface 27A1 of the cleaning frame 27.

In further detail, in the embodiment, as in the first embodiment, the support portion 27*b* of the cleaning frame 27 is formed on the rack portion 27*b*1 which has a substantial L-shape in cross-section as viewed in the direction of the rotation axis of the photosensitive drum 1 and is projected from the inner surface 27A1 of the cleaning frame 27. In the embodiment, the first positioning surface 27*p* is formed of a side surface of the horizontal rack portion 27*b*3 on the side of the support member 8 along the −Y direction of the rack portion 27*b*1. Further, in the embodiment, in a position opposed to the horizontal rack portion 27*b*3 of the support portion 27*b* in the direction of the rotation axis of the photosensitive drum 1, a protruding portion 27*n* having the same shape as that of horizontal rack portion 27*b*3 is projected from the inner surface 27A1 of the cleaning frame 27. The protruding portion 27*n* is inserted into the through-hole 8*g*. In the embodiment, the second positioning surface 27*s* is formed of a side surface of the protruding portion 27*n* on the side of an end portion thereof in the direction of the rotation axis of the photosensitive drum 1.

Figures 28A, 28B, 28C:
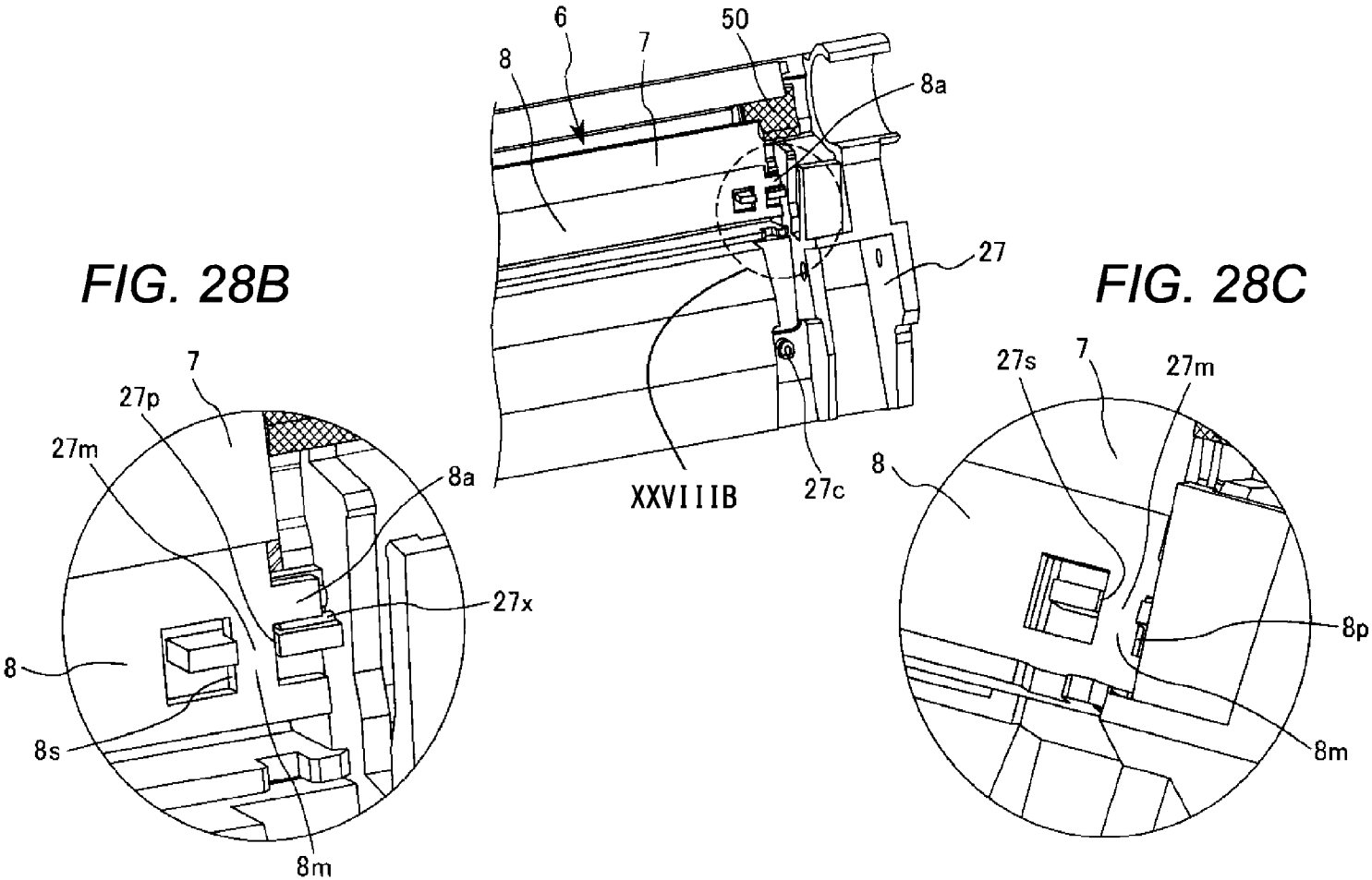
FIG. 28A is another perspective view of the cleaning frame and a cleaning member according to the yet another embodiment of the present invention.
FIG. 28B is a partially enlarged perspective view of an encircled portion XXVIIIB in FIG. 28A.
FIG. 28C is a partially enlarged perspective view of a positioned portion of FIG. 28B as viewed in another direction.

As illustrated in FIGS. 28A, 28B, and 28C, the positioned portion 8*m* of the cleaning member 6 is engaged with the positioning portion 27*m* of the cleaning frame 27. With this, while allowing the cleaning member 6 to pivot about the abutment portion 8*a* as a pivot axis, the cleaning member 6 can be positioned in the longitudinal direction thereof with respect to the cleaning frame 27.

Figure 29:
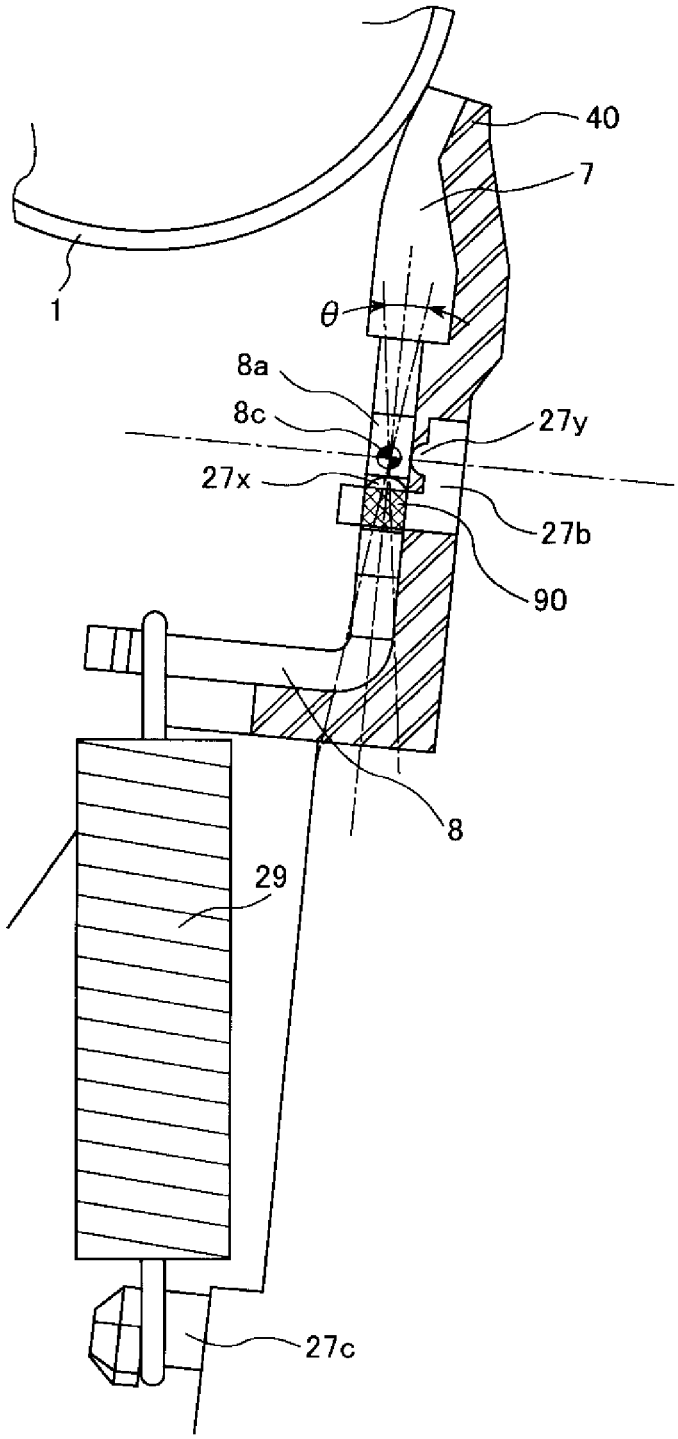
FIG. 29 is a partial sectional view of the cleaning unit according to the yet another embodiment of the present invention, for illustrating a positioning region of a positioning portion.

Further, in a positioning region 90 indicated by hatching in FIG. 29, the first positioned surface 8*p* and the second positioned surface 8*s* are in contact with the first positioning surface 27*p* and the second positioning surface 27*s*, respectively, so as to position the cleaning member 6 in the longitudinal direction thereof.

As described above, in the embodiment, the first positioned surface 8*p* is a surface adjacent to the second abutment portion 8*x*, and the positioning region 90 is located near the pivot center 8*c* of the cleaning member 6. With this, when the cleaning member 6 pivots within a pivotable range θ, an amount of sliding between the first positioned surface 8*p* and the first positioning surface 27*p* and an amount of sliding between the second positioned surface 8*s* and the second positioning surface 27*s* can be suppressed. Thus, grinding of the first positioned surface 8*p* and the first positioning surface 27*p*, and grinding of the second positioned surface 8*s* and the second positioning surface 27*s* can be suppressed.

As described above in the embodiment, the structure of positioning the cleaning member 6 in the longitudinal direction thereof with respect to the cleaning frame 27 is provided at one point on the side of the one end portion (front end portion) in the direction of the rotation axis of the photosensitive drum 1.

Figure 30:
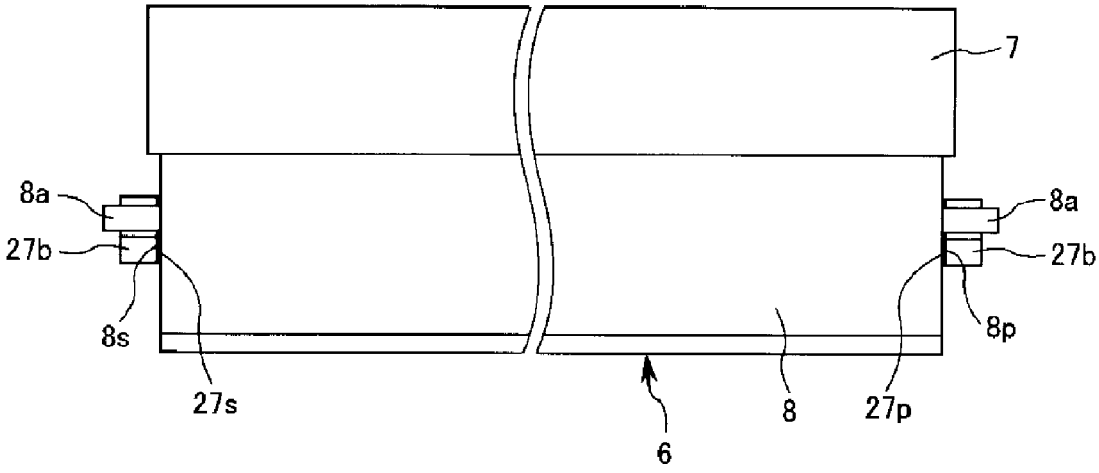
FIG. 30 is a main-part schematic view of the cleaning frame and the cleaning member according to the yet another embodiment of the present invention, for illustrating another arrangement example of a positioned surface.

Note that, as illustrated in FIG. 30, the other side surface of the support member 8 and the other side surface of the support portion 27*b* on the other end portion on the other side, which is opposite to the side on which the first positioned surface 8*p* and the first positioning surface 27*p* in the embodiment are provided, in the longitudinal direction of the cleaning member 6 may be utilized as the second positioned surface 8*s* and the second positioning surface 27*s*, respectively. Also in this case, the second positioned surface 8*s*, which is a side surface of the support member 8 on the other end portion on the opposite side, is located opposite to the first positioned surface 8*p*.

As described above, according to the embodiment, one of the positioned surfaces configured to position the cleaning member 6 in the longitudinal direction thereof is provided adjacent to a supported surface (specifically, second abutment portion 8*x*) of the cleaning member 6. In particular, in the embodiment, one side surface of the support portion 27*b* of the cleaning frame 27 is used as the positioning surface which is engaged with the one of the positioned surfaces of the cleaning member 6. With this, abrasions of the cleaning frame 27 and the cleaning member 6 caused by the pivotal movement of the cleaning member 6 can be suppressed.

Other Embodiment

The present invention is specifically described by way of embodiments. However, the present invention is not limited by the embodiments described above.

Figure 31A:
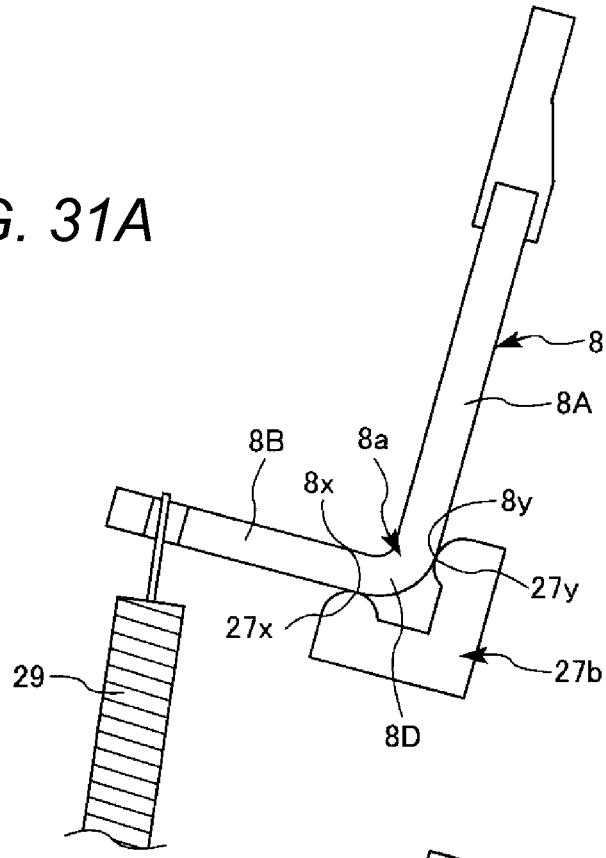
FIGS. 31A and 31B are schematic views of a substantial part of a cleaning frame and a cleaning member according to another modification of the present invention.

In the embodiments described above, the abutment portion 8*a* is projected from the end portion in the longitudinal direction of the main part 8A of the support member 8. However, the present invention is not limited thereto. For example, as illustrated in FIG. 31A, at each of both the end portions in the longitudinal direction of the support member 8, a side surface of the main part 8A and a side surface of the strengthening part 8B, which are each adjacent to the bent part 8D of the support member 8, may be used as they are as the first abutment portion 8*y* and the second abutment portion 8*x*, respectively. Note that, the strengthening part 8B, which is bent with respect to the main part 8A, needs not be formed over the entire length of the support member 8 in the longitudinal direction. The strengthening part may be formed only at each of both the end portions of the support member 8 in the longitudinal direction.

Figure 31B:
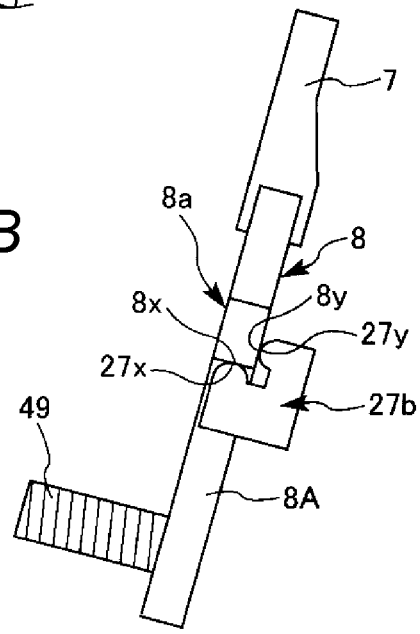

Further, in the embodiments described above, the support member 8 includes the main part 8A and the strengthening part 8B bent at the bent part 8D with respect to the main part 8A. However, the present invention is not limited thereto. For example, as illustrated in FIG. 31B, the support member 8 may include only a part corresponding to the main part 8A in the embodiments described above, and the abutment portion 8*a* similar to that in the embodiments described above may be provided at an edge portion along a longitudinal direction of that part. Further, in the embodiments described above, the tension spring is used as the urging member. However, for example, in a case of using the support member 8 illustrated in FIG. 31B, a compression spring 49 may be used as the urging member. In this case, the compression spring 49 is arranged between the receiving portion 27*e* provided to the cleaning frame 27 and the acting portion of the support member 8, which is urged by the urging member. With this, the support member 8 can be urged in a direction in which the rubber blade 7 is brought into abutment with the photosensitive drum 1, to thereby pivot the support member 8 about the abutment portion 8*a* as a pivot axis.

According to the embodiments, the cleaning member can be supported in a pivotable manner with a simple structure such as the frame without use of the separate member such as the pin, to thereby achieve reduction in manufacturing cost and to enable easier assembly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-101857, filed Apr. 26, 2012, which is hereby incorporated by reference herein in its entirety.

What is claimed is:

1. A cleaning unit, comprising:
- a rotatable photosensitive drum;
- a cleaning member configured to remove toner from the photosensitive drum; and
- a frame configured to support the photosensitive drum and the cleaning member,
- wherein the cleaning member includes:
  - an elastic member which abuts against the photosensitive drum; and
  - a support member configured to support the elastic member,
- wherein the support member has frame abutment portions which abut against the frame at both end portions of the support member in a direction along a direction of a rotation axis of the photosensitive drum, respectively,
- wherein each of the frame abutment portions has:
  - a first abutment portion formed by a surface extending in one direction; and
  - a second abutment portion formed by a surface extending in another direction intersecting with the one direction,
    - the first abutment portion being directed to a side opposite to a side of the photosensitive drum with respect to a first axis extending from a corresponding one of the frame abutment portions to the elastic member as viewed in the direction of the rotation axis of the photosensitive drum,
    - the second abutment portion being directed to a side opposite to a side of the elastic member with respect to a second axis substantially orthogonal to the first axis,
- wherein the frame includes cleaning member support portions which abut against the frame abutment portions at both the end portions of the support member, respectively,
- wherein each of the cleaning member support portions has:
  - a first support portion which abuts against the first abutment portion; and
  - a second support portion which abuts against the second abutment portion,
    - the cleaning member support portions supporting the cleaning member in a pivotable manner about the frame abutment portions as a pivot axis, and
- wherein the cleaning unit further comprises an urging member configured to urge the cleaning member in a direction in which the elastic member is brought into contact with the photosensitive drum by pivoting the cleaning member about the frame abutment portions as the pivot axis.

2. A cleaning unit according to claim 1, wherein the support member comprises a plate-shaped main part extending substantially in parallel to the direction of the rotation axis of the photosensitive drum, and the frame abutment portions are projected from the plate-shaped main part at both end portions of the plate-shaped main part in the direction along the direction of the rotation axis of the photosensitive drum, respectively.

3. A cleaning unit according to claim 2, wherein the first abutment portion is flush with a surface of the plate-shaped main part on the side opposite to the side of the photosensitive drum with respect to the first axis.

4. A cleaning unit according to claim 1, wherein the support member comprises a sheet metal punched out through press working, the second abutment portion comprises a cut edge surface obtained through the press working, and the second support portion abuts against a shear surface zone of the cut edge surface.

5. A cleaning unit according to claim 1, wherein the first support portion and the second support portion are each formed into a circular-arc shape or a protruding shape having an apex in cross-section as viewed in the direction of the rotation axis of the photosensitive drum.

6. A cleaning unit according to claim 1, wherein, as viewed in the direction of the rotation axis of the photosensitive drum, a distance between an intersection point of a straight line extending along the second axis from a contact position between the first abutment portion and the first support portion and a straight line extending along the first axis from a contact position between the second abutment portion and the second support portion, and the contact position between the first abutment portion and the first support portion is substantially equal to a distance between the intersection point and the contact position between the second abutment portion and the second support portion.

7. A cleaning unit according to claim 1, wherein, as viewed in the direction of the rotation axis of the photosensitive drum, a distance between an intersection point of a straight line extending along the second axis from a contact position between the first abutment portion and the first support portion and a straight line extending along the first axis from a contact position between the second abutment portion and the second support portion, and a contact position between the elastic member and the photosensitive drum is substantially equal to a distance between the intersection point and an acting portion of the support member urged by the urging member.

8. A cleaning unit according to claim 1, wherein the frame comprises a regulating portion configured to regulate a movement of a corresponding one of the frame abutment portions in a direction in which the first abutment portion is moved away from the first support portion, and the regulating portion is opposed to a regulated portion of the cleaning member from the side of the photosensitive drum with a predetermined clearance between the regulating portion and the regulated portion while allowing the cleaning member to pivot about the frame abutment portions as the pivot axis.

9. A cleaning unit according to claim 8, wherein the regulating portion is provided in each of two or more points in the direction along the direction of the rotation axis of the photosensitive drum.

10. A cleaning unit according to claim 9, wherein the regulating portion is provided correspondingly to each of both end portions of the cleaning member in the direction along the direction of the rotation axis of the photosensitive drum.

11. A cleaning unit according to claim 8, wherein the support member comprises a plate-shaped main part extending substantially in parallel to the direction of the rotation axis of the photosensitive drum, and the regulated portion is projected from the plate-shaped main part at an end portion of the plate-shaped main part in the direction along the direction of the rotation axis of the photosensitive drum.

12. A cleaning unit according to claim 8, wherein, in the direction in which the first abutment portion is moved away from the first support portion, a distance between a contact position between the first abutment portion and the first support portion and a contact position between the second abutment portion and the second support portion is equal to or larger than the predetermined clearance.

13. A cleaning unit according to claim 8, wherein the frame is formed by coupling a first frame part provided with at least the cleaning member support portions to a second frame part configured to support the photosensitive drum in a rotatable manner, and the regulating portion is provided on the second frame part.

14. A cleaning unit according to claim 1, wherein the support member includes:

a first positioned surface which is formed of a side surface of one of the both end portions of the support member in the direction along the direction of the rotation axis of the photosensitive drum, the side surface being adjacent to a corresponding one of the frame abutment portions; and a second positioned surface located opposite to the first positioned surface, and wherein the frame comprises:

a first positioning surface which comes into contact with the first positioned surface so as to position the cleaning member in the direction of the rotation axis of the photosensitive drum; and a second positioning surface which comes into contact with the second positioned surface so as to position the cleaning member in the direction of the rotation axis of the photosensitive drum.

15. A cleaning unit according to claim 14, wherein the support member comprises a plate-shaped main part extending substantially in parallel to the direction of the rotation axis of the photosensitive drum, and the frame abutment portions are projected from the plate-shaped main part at both end portions of the plate-shaped main part in the direction along the direction of the rotation axis of the photosensitive drum, respectively, wherein the first positioned surface is formed of a side surface of a corresponding one of the both end portions of the plate-shaped main part in the direction along the direction of the rotation axis of the photosensitive drum, the side surface being adjacent to the second abutment portion, and wherein the first positioning surface is formed of a side surface of a rack portion projected from an inner surface of the frame, the rack portion being provided with the second support portion.

16. A cleaning unit according to claim 15, wherein the second positioned surface is formed of an inner side surface of a hole formed in the plate-shaped main part, and wherein the second positioning surface is formed of a side surface of a protruding portion which is projected from the inner surface of the frame and inserted into the hole.

17. A cleaning unit according to claim 16, wherein the first positioned surface, the second positioned surface, the first positioning surface, and the second positioning surface are provided at one point in the direction along the direction of the rotation axis of the photosensitive drum.

18. A process cartridge, comprising a cleaning unit according to claim 1, wherein the process cartridge is removably mounted to a main body of an electrophotographic image forming apparatus, and wherein the electrophotographic image forming apparatus transfers a toner image, which is formed on the photosensitive drum of the cleaning unit, onto a recording material, fixes the toner image to the recording material, and outputs the recording material.

19. An electrophotographic image forming apparatus, comprising a process cartridge according to claim 18, wherein the process cartridge is removably mounted to a main body of the electrophotographic image forming apparatus, and wherein the electrophotographic image forming apparatus transfers a toner image, which is formed on the photosensitive drum of the process cartridge, onto a recording material, fixes the toner image to the recording material, and outputs the recording material.

* * * * *